United States Patent [19]
Fabrig
[11] 4,232,858
[45] Nov. 11, 1980

[54] METHOD AND MEANS FOR MANIPULATING MARGINALLY PERFORATED NOTE BOOKS PRIOR TO INTRODUCTION OF SPIRALS

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 943,814

[22] Filed: Sep. 19, 1978

Related U.S. Application Data

[63] Continuation-in-part of Ser. No. 854,835, Nov. 25, 1977, Pat. No. 4,157,821.

[30] Foreign Application Priority Data

Oct. 9, 1968 [DE] Fed. Rep. of Germany ..... 1817815
Feb. 1, 1978 [DE] Fed. Rep. of Germany ..... 2804180

[51] Int. Cl.[3] ..... B42B 5/12
[52] U.S. Cl. ..... 270/53; 11/1 A
[58] Field of Search ..... 270/52, 53, 58; 11/1 A; 281/21 A; 271/232

[56] References Cited

U.S. PATENT DOCUMENTS 4,157,821 6/1979 Febrig ..... 270/53

*Primary Examiner*—Paul T. Sewell
*Attorney, Agent, or Firm*—Peter K. Kontler

[57] ABSTRACT

Note books having marginal holes are manipulated prior to insertion of spirals which are to be transformed into binders so as to convert the holes into arcuate passages or into V-shaped passages located in planes each making with a row of holes an angle which approximates the helix angle of the spiral. The conversion takes place in two stages, either at two discrete aligning stations or at a single station. If the conversion takes place at two stations, the holes receive the tips of pairs of mandrels which are thereupon pivoted to convert all holes into V-shaped passages. At the second station, a comb introduces its arcuate prongs into some or all of the V-shaped passages. If the conversion takes place at a single station, some of the holes receive the tips of mandrels introduced from one side and some of the holes receive the tips of mandrels introduced from the other side of the note book. The mandrels are thereupon pivoted to convert all holes into V-shaped passages. The mandrels are also pivoted about axes extending at right angles to the row of perforations in a sheet to place the V-shaped passages into planes making an oblique angle with the planes of the sheets. The oblique angle approximates or matches the helix angle of the spiral.

36 Claims, 29 Drawing Figures

X
Y
1
3
4
6
6a
6b
7
8
8a
9
11
12
13
14
16
17
18
19
21
22
23
24

1
2
27
6b
28a
26
29
38
32
35
33
34
36
37
93A
29a
93
TO
IV 1
2
6b
26
28
28a
29

36
96
77
79
94a
78
94b
37
92A
92B
91
97
101
100
92a
H2
92b
124
95
39
93A
102
39
38
29
121
99
39
29
93
122
125
98
38
32
29
39

METHOD AND MEANS FOR MANIPULATING MARGINALLY PERFORATED NOTE BOOKS PRIOR TO INTRODUCTION OF SPIRALS

CROSS-REFERENCE TO RELATED CASES

This is a continuation-in-part of my copending application Ser. No. 854,835 filed Nov. 25, 1977, now U.S. Pat. No. 4,157,821 granted June 22, 1979. The matter which is shown in FIGS. 1 to 15 of the present application is also shown and described in the commonly owned copending applications Ser. Nos. 854,818 and 855,016, both filed Nov. 25, 1977. The application Ser. No 854,818 has matured into U.S. Pat. No. 4,161,196 granted July 17, 1979, and the application Ser. No. 855,016 has matured into U.S. Pat. No. 4,165,766 granted Aug. 28, 1979.

BACKGROUND OF THE INVENTION

The present invention relates to a method and apparatus for making note books or pads whose leaves or sheets have straight rows of marginal perforations for reception of spiral binders which hold the leaves together. More particularly, the invention relates to a method and arrangement for manipulating marginally perforated note books or pads prior to insertion of metallic or plastic spirals which are thereupon transformed into spiral binders. The spirals are actually circular helices, i.e., they resemble space curves traced on a cylinder. However, such bodies are popularly known as spirals and the binders which are obtained by subdivision and trimming of metallic or plastic circular helical bodies are commonly known as spiral binders. Therefore, the following description will refer to spirals and spiral binders with the understanding that the spirals are circular helices.

In presently known apparatus for the production of so-called spiral binder note books or pads, the holes consisting of registering perforations in the leaves or sheets are converted into arcuate passages for convenient introduction of the leader of a spiral by shifting the leaves relative to each other so that each originally straight hole assumes an arcuate shape. To this end, a profiling device is caused to move against the rear edge face of a note book and to thereby effect an appropriate displacement of neighboring sheets relative to each other. That surface of the profiling device which engages the rear edge face of the note book has a curvature matching the curvature of the convolutions of a metallic spiral which is thereupon threaded through the perforations of the sheets. A drawback of such arrangement is that predictable shifting of sheets which form a pad is insured only when the note books are relatively thin and/or when the size of the sheets is small.

It is also known to employ the profiling device in combination with arcuate prongs which are introduced into the holes of a note book prior to engagement of the rear edge face of the note book with the profiling device. The curvature and helix angle of the prongs equal or approximate those of the convolutions of a spiral. Since the prongs are introduced into straight holes, the sheets must be formed with large-diameter perforations, especially, if the diameter of the spiral is relatively small. Such apparatus, too, fail to insure that the leader of a spiral will invariably find its way during threading through the perforations of a pile of sheets which form a note book.

OBJECTS AND SUMMARY OF THE INVENTION

An object of the invention is to provide a novel and improved method of changing the configuration of a straight row of holes which consist of registering perforations provided in one marginal portion of each sheet of a pile which may constitute one or more discrete note books or pads and is about to receive a spiral having a predetermined radius.

Another object of the invention is to provide a method which renders it possible to predictably change the configuration of marginal holes in piles of overlapping paper sheets or the like regardless of the number of sheets and/or the thickness of the pile.

A further object of the invention is to provide a method which can be resorted to for rapid and predictable displacement or shifting of sheets in a pile which constitutes one or more note books or pads.

An additional object of the invention is to provide a method whose reliability is not dependent on the size of sheets, i.e., on the length of the row of holes in the pile, and which can be resorted to for predictable shaping of holes regardless of the diameters of perforations of which the holes consist.

Still another object of the invention is to provide a novel and improved arrangement for the practice of the above outlined method.

Another object of the invention is to provide the arrangement with novel and improved aligning means which can be utilized to insure predictable conversion of a straight row of normally straight holes into passages whose configuration is best suited or at least adequate to insure unimpeded insertion of the leader of a spiral.

An ancillary object of the invention is to provide an aligning unit which can effect a desirable coarse conversion of straight holes into passages whose configuration resembles the optimum configuration, or which can effect coarse as well as precise or final conversion of straight holes into passages whose configuration matches or closely approximates the optimum configuration.

One feature of the invention resides in the provision of a method of changing the configuration of each of a straight row of holes consisting of registering perforations provided in one marginal portion of each sheet of a pile of sheets which is about to receive a spiral (i.e., a circular helix) having a predetermined radius and a predetermined helix angle and serving to hold the sheets of the pile together. The method comprises the steps of simultaneously converting all holes of the pile into substantially V-shaped passages, and thereupon simultaneously converting all V-shaped passages into arcuate passages having radii of curvature and helix angles which at least approximate the predetermined radius and the predetermined helix angle, or simultaneously moving all V-shaped passages from planes which are normal to the row of perforations in a sheet of the pile into planes making an oblique angle with the row of perforations. Such oblique angle matches or approximates the helix angle of the spiral. The helix angle is measured between a line which is tangent to a convolution of the spiral and the axis of the spiral.

The first mentioned converting step preferably includes introducing into each hole, into a single hole or into two different holes a pair of mandrels from opposite sides of the pile and pivoting at least one mandrel of each pair with respect to the other mandrel of the respective pair.

The step of converting V-shaped passages into arcuate passages, may comprise inserting one or more arcuate prongs into one or more V-shaped passages of the pile to thereby effect a relative movement between the sheets of the pile and the prongs so that all sheets abut against the prongs. The radii of curvature and the helix angles of the prongs match or closely approximate the radius and helix angle of the spiral.

The step of changing the planes of the V-shaped passages may comprise pivoting the mandrels about axes which are substantially normal to the row of perforations in any sheet of the pile. The mandrels are pivoted in the same direction and are preferably shifted relative to each other in the longitudinal direction of the rows of perforations to insure that the V-shaped passages are not interrupted at the apices as a result of pivoting of mandrels about axes which are substantially normal to a row of perforations.

The tips of the mandrels can extend beyond the planes halving the respective piles, especially if each hole receives a single mandrel or if the hole or holes which receive one or more mandrels extending from one side of the pile is or are not identical with the hole or holes which receive one or more mandrels extending from the other side of the pile. The arrangement may be such that a single first mandrel extends into a hole from one side of the pile and such mandrel extends through at least one half of the sheets in the pile, and a single second mandrel extends into another hole from the other side of the pile and such mandrel extends through at least one half of the sheets in the pile. Thus, one or more sheets in the middle of the pile can be speared by the tips of both mandrels.

It will be seen that each embodiment of the improved method includes a step of simultaneously converting all holes into passages of a first type whose configuration resembles but need not match the configuration of convolutions of a spiral (circular helix), namely, the projection of a convolution into a plane which is normal to the axis of the spiral. In accordance with the presently preferred mode of practicing the method, the passages of the first type are V-shaped passages which are disposed in parallel planes at right angles to the row of perforations in any sheet of the pile. The conversion of straight holes into V-shaped passages includes moving at least some sheets of the pile at right angles to the perforated marginal portions of such sheets. The improved method further includes the second step of simultaneously converting all (V-shaped) passages of the first type or all straight holes into passages of a second type whose configuration more closely resembles the configuration of convolutions of the spiral than the configuration of passages of the first type. The configuration of passages of the second type more closely resembles the configuration of convolutions of the spiral because the curvature of the passages of the second type approximates or matches the curvature of convolutions, and the planes of the passages of the second type make with the rows of perforations an oblique angle which approximates or matches the helix angle of a convolution, or because the planes of passages of the second type make with the rows of perforations an oblique angle which approximates or matches the helix angle of the spiral even though the curvature of passages of the second type does not approximate or match the curvature of convolutions (i.e., the passages of the second type may resemble or constitute V-shaped passages).

The step of changing the inclination of holes or V-shaped passages so that the resulting passages are inclined with respect to the planes of the sheets at an angle which approximates or equals the helix angle of the spiral includes moving some or all of the sheets in the longitudinal direction of perforated marginal portions of the sheets.

The two steps can be carried out simultaneously or one after the other. For example, the straight holes can be converted into V-shaped passages located in planes which are normal to the perforated marginal portions of the sheets, and such V-shaped passages are thereupon converted into arcuate or V-shaped passages located in planes making with the planes of the sheets an angle which equals or approximates the helix angle of the spiral. However, the holes can be converted into passages which make with the planes of the sheets an angle equal to or approximating the helix angle prior to, or simultaneously with shifting of some or all of the sheets at right angles to their perforated marginal portions. In other words, shifting of some or all of the sheets in the longitudinal direction of their perforated marginal portions may precede, take place simultaneously with or follow the shifting of at least some sheets at right angles to their perforated marginal portions.

Each sheet of the pile may be a composite sheet consisting of at least two immediately adjacent leaves, i.e., the pile may constitute a group of two or more immediately adjacent registering note books or pads.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of an apparatus which embodies the arrangement and serves to convert sheets and spirals into spiral binder note books.

DESCRIPTION OF THE PREFERRED EMBODIMENTS

Figures 1A, 2A:
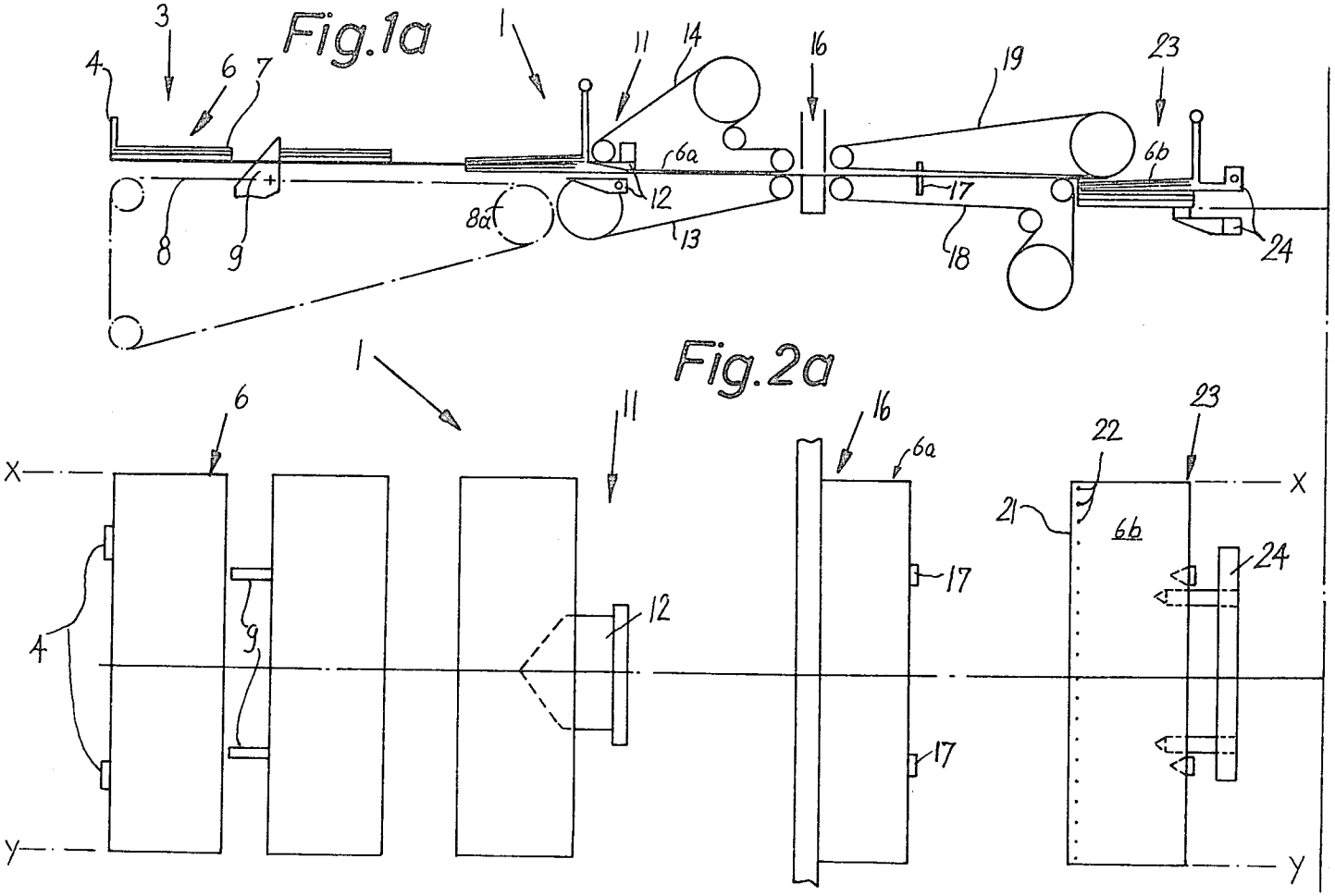
FIG. 1*a* is a schematic side elevational view of a first portion of an apparatus including an arrangement which embodies one form of the invention and serves to convert the holes of a pile of sheets into arcuate passages whose curvature and helix angle match the curvature and helix angle of convolutions of a spiral.
FIG. 2*a* is a schematic plan view of the structure shown in FIG. 1*a;*

Referring first to FIGS. 1*a*, 1*b*, 2*a* and 2*b*, the apparatus which is shown therein comprises an elongated straight first transporting and processing section 1 and an arcuate second transporting and processing section 2 which is located behind the section 1, as considered in the direction of transport of processed material.

The first section 1 includes a feeding or stack assembling station 3 wherein elongated sheets 7 of paper or the like are placed by hand against a locating stop 4 so that the sheets 7 form a stack 6. The length of the sheets 7 (as considered at right angles to the plane of FIG. 1*a*) is several (e.g., four) times the width of a note book or pad 29 (see FIGS. 2*b* and 9). The sheets 7 are placed against the locating stop 4 during the intervals of idleness of an intermittently operated endless sheet transporting belt conveyor 8 having one or more entraining elements 9 which can bypass the two-piece stop 4 (see FIG. 2*a*) to advance a freshly formed stack 6 in a direction to the right, as viewed in FIG. 1*a* or 2*a*. The means for intermittently driving the conveyor 8 is of conventional design and is not shown in the drawing. Such driving means can transmit torque to the shaft of one of the pulleys 8*a* for the conveyor 8.

The entraining element 9 transports successive stacks 6 to a subdividing unit 11 which breaks up each stack 6 into a series of smaller stacks 6*a* (e.g., into two stacks of equal height). To this end, the subdividing unit 11 comprises a blade-like proportioning device or tongs 12 which extends into the path of movement of the front side of an oncoming stack 6. Successive smaller stacks 6*a* are engaged and transported by the neighboring reaches of two endless belt conveyors 13 and 14. The gap between the conveyors 13 and 14 is located in or close to the plane of the upper reach of the conveyor 8. The stacks 6*a* which are transported by the conveyors 13 and 14 are brought to a halt in a punching or perforating unit 16 which includes suitable means (not specifically shown) for providing the trailing portion of each stack 6*a* with a row of equally spaced holes of perforations 22 (shown in FIG. 2*a*). Each row of perforations 22 extends at right angles to the direction of movement of the stacks 6*a*. Each stack 6*a* which is provided with a row of perforations 22 is engaged and transported by the neighboring reaches of two intermittently driven endless belt conveyors 18 and 19 which deliver successive stacks 6*a* to a collecting or stacking unit 23. The conveyors 18, 19 are provided with aligned stops 17 which extend into the path of movement of an oncoming stack 6*a* and arrest the stack in an optimum position with respect to the perforating unit 16 so that the distance between the row of perforations 22 and the rear end face 21 of each stack 6*a* is the same.

The collecting unit 23 converts several successive perforated stacks 6*a* into a larger stack 6*b* wherein the number of sheets 7 may but need not equal the number of sheets in a stack 6. The number of sheets 7 in each stack 6*b* equals the number of sheets or leaves in a pad 29. The means for withdrawing successive stacks 6*b* from the collecting unit 23 comprises a mobile gripping or transferring device 24 with two sets of jaws which are movable into engagement with the uppermost and lowermost sheets of successive stacks 6*b*. The transferring device 24 can advance successive stacks 6*b* through a distance which suffices to move such stacks into the range of intermittently driven entraining elements or pushers 26 shown in FIGS. 1*b* and 2*b*. Each pusher 26 preferably comprises several aligned teeth or like components which engage spaced-apart portions of the rear end face of the respective stack 6*b*. The pushers 26 are mounted on an endless conveyor belt or chain (not specifically shown) which transports them along an endless path having a horizontal upper portion which is shown in FIGS. 1*b* and 2*b*.

The pushers 26 advance successive stacks 6*b* into the range of a severing unit 27 having three knives 28 which are parallel to the direction of movement of pushers 26 and descend when the stack 6*b* therebelow is idle to thus convert such stack into four aligned note books or pads 29. If desired, the severing unit 27 may comprise two additional knives 28*a* which trim the respective lateral marginal portions of the stack 6*b* at the severing station. The pushers 26 thereupon transport successive groups or sets of four registering pads 29 each to the first station of an intermittently driven rotary conveyor or turret 32 which is indexible about a horizontal axis 35 normal to the direction of movement of pads 29 with the pushers 26. The pushers 26 deliver successive groups of pads 29 into successive holders 38 of the turret 32 at the nine o'clock position of the turret, as viewed in FIG. 1*b*. The respective pushers 26 are thereupon returned in a direction to the left, as viewed in FIG. 1*b*, to engage and entrain freshly assembled stacks 6*b* in the region of the gripping device 24.

Figure 1B:
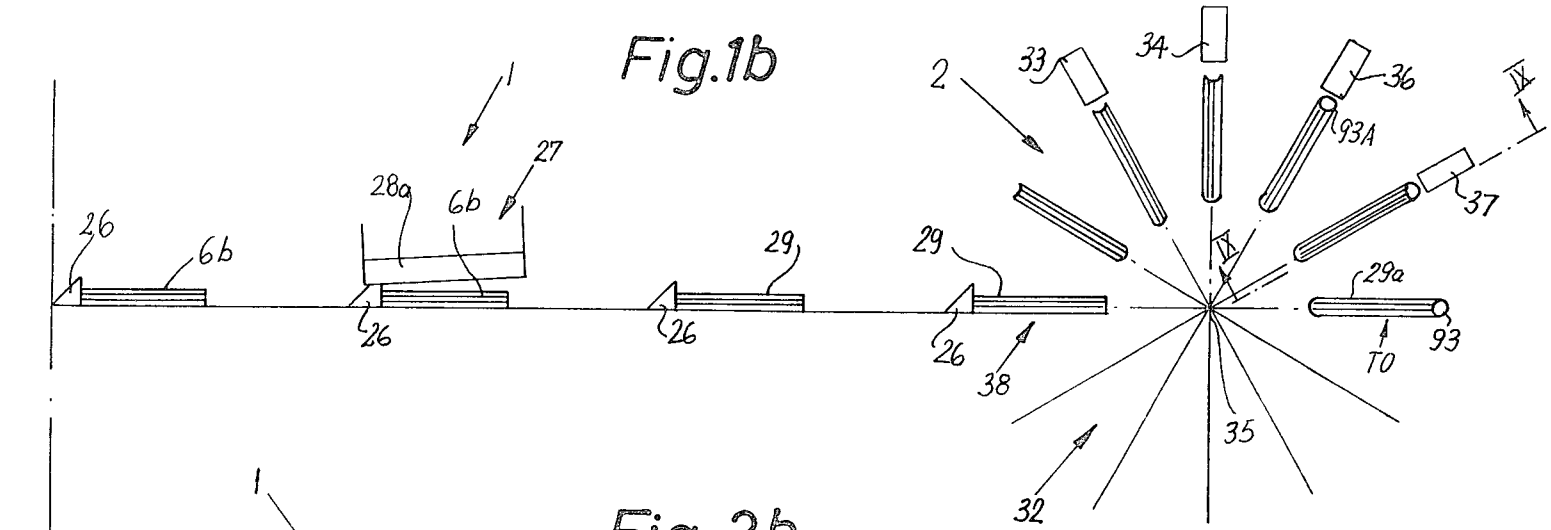
FIG. 1*b* is a schematic side elevational view of a second portion of the apparatus, namely, that portion which includes the improved arrangement.
Figure 2B:
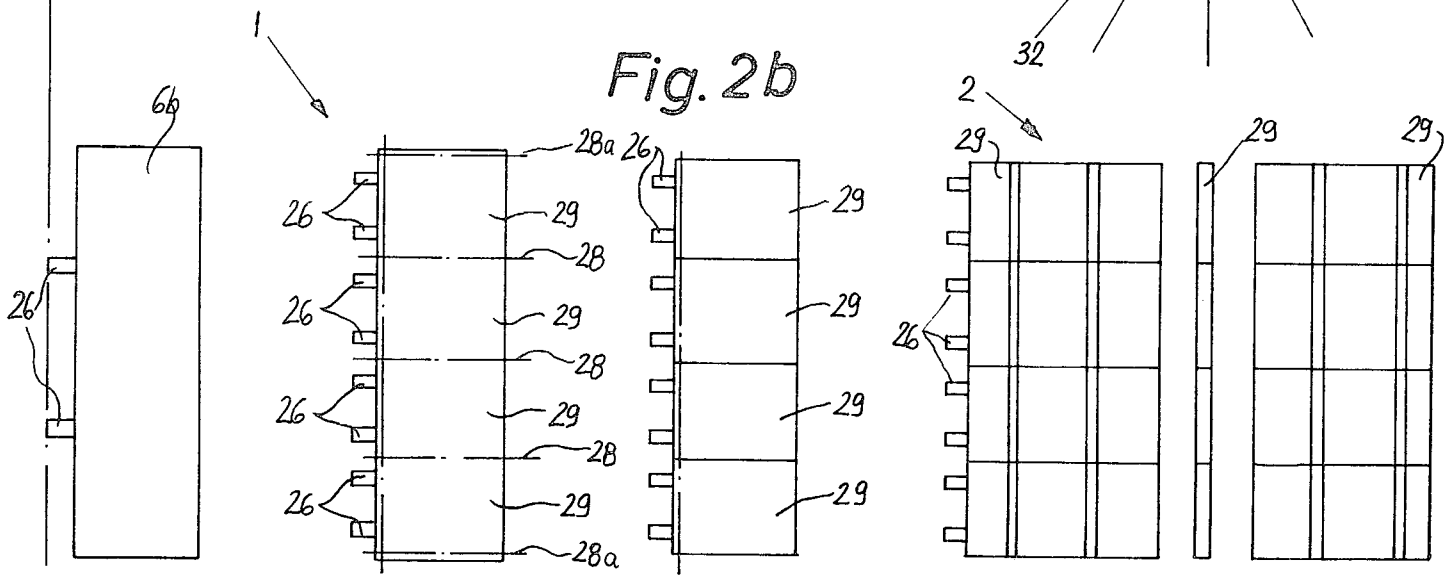
FIG. 2*b* is a schematic plan view of the structure shown in FIG. 1*b;*
Figure 3A:
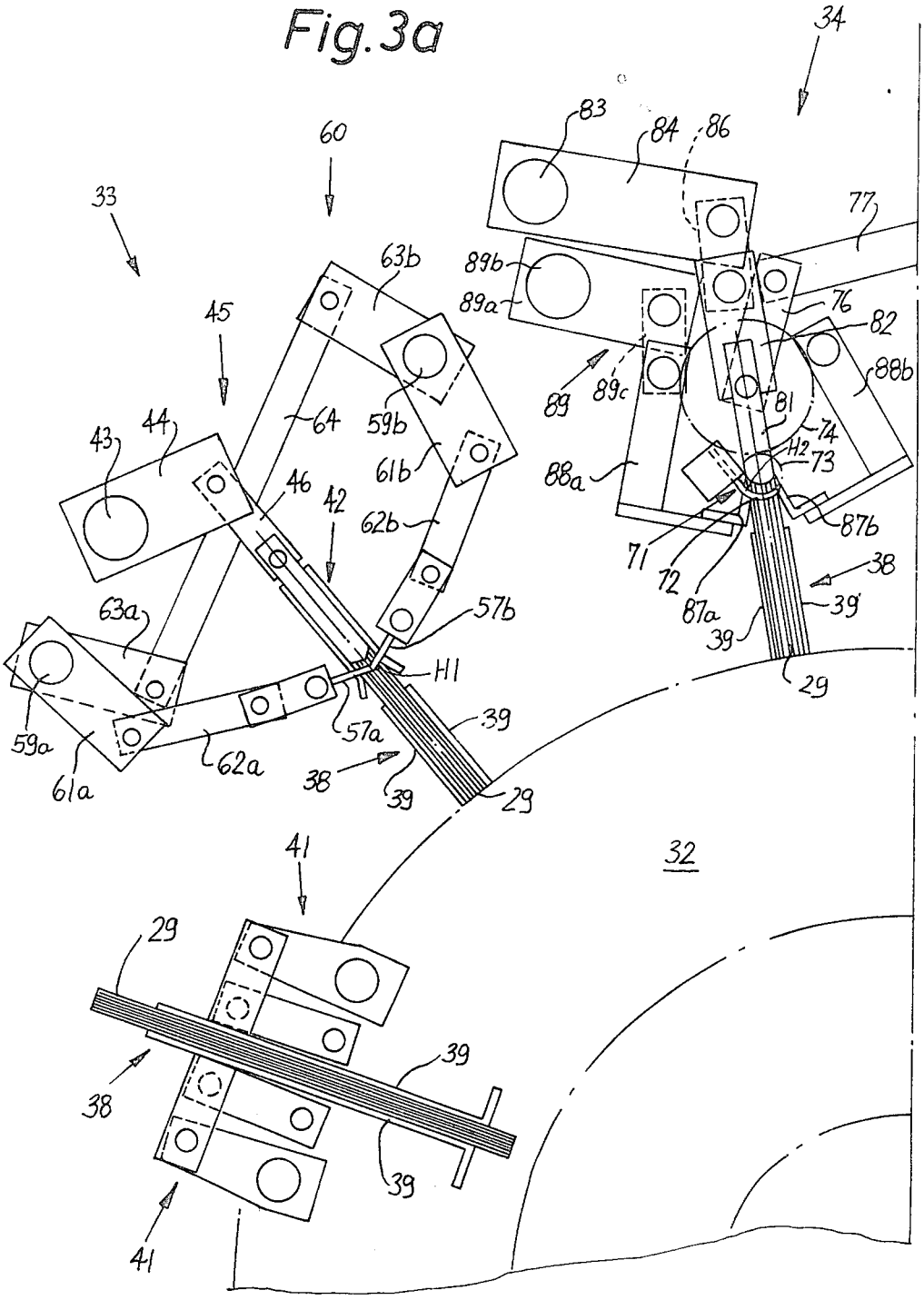
FIG. 3*a* is a schematic end elevational view of the upper left-hand portion of a turret-shaped conveyor forming part of the structure shown in FIG. 1*b* and constituting one component of the improved arrangement, this Figure further showing two aligning units of the improved arrangement.
Figure 3B:
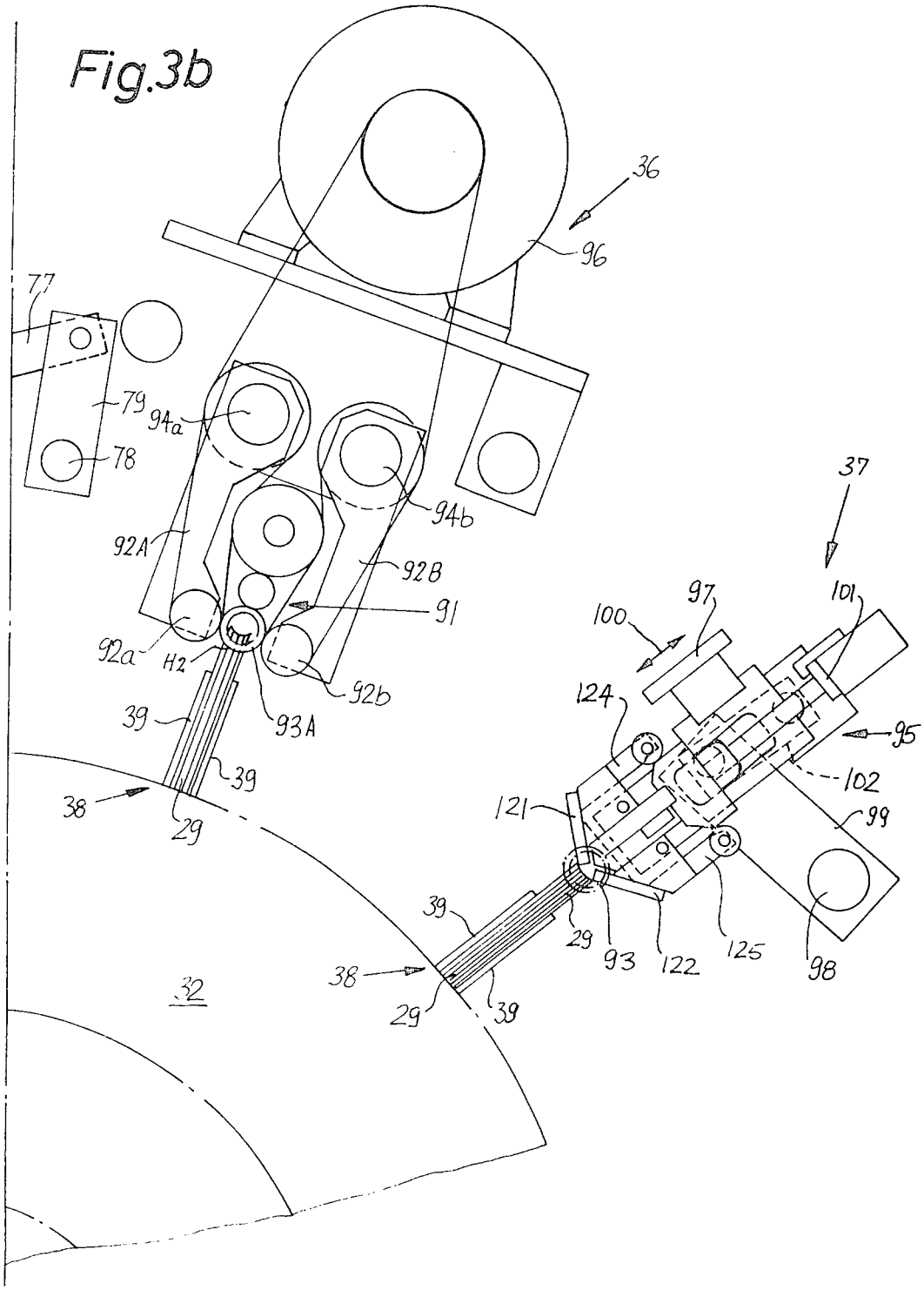
FIG. 3*b* is a schematic end elevational view of the upper right-hand portion of the turret-shaped conveyor in the structure of FIG. 1*b,* further showing a spiral inserting unit and a spiral severing and binder deforming unit.

FIGS. 1*b*, 3*a* and 3*b* show that the turret 32 transports successive groups of pads 29 past a first aligning unit 33 (located at or close to the eleven o'clock position), thereupon past a second aligning unit 34 (located at or close to the twelve o'clock position) past a spiral introducing unit 36 (located at or close to the one o'clock position), past a wire trimming or severing and deforming unit 37 (located at or close to the two o'clock position) and finally to a take-off station TO at which the groups of fully assembled (finished) pads 29*a* (each having a spiral binder 93) are removed from the turret 32 for delivery to storage, to a conveyance or to a further processing station, not shown.

Each holder 38 of the turret 32 defines a chamber which can receive an entire group of four registering pads 29, and each of these holders comprises gripping means consisting of two spaced-apart jaws or claws 39 at least one of which can be moved toward and away from the other jaw by means of a linkage 41 (FIG. 3*a*) receiving motion at predetermined intervals from a cam (not specifically shown) which is preferably mounted on the shaft for the turret 32. When the jaws 39 are moved to their operative positions, they engage and grip the respective outermost sheets of the group of registering pads 29 in the corresponding holder 38 but leave the perforated portions of the pads exposed (see also FIG. 9). The configuration of the aforementioned actuating cam for the linkages 41 of the holders 38 is such that the jaws 39 of each holder 38 move apart at the nine o'clock position of the turret 32 (in order to receive a fresh group of registering pads 29), at the ten o'clock position (in order to allow for first or preliminary alignment of sheets which constitute the respective group of registering pads 29), at the eleven o'clock position (in order to allow for a second or final alignment or adjustment of sheets which constitute the respective group of registering pads 29), and at the three o'clock position to allow for removal of finished pads 29*a* from the respective holder 38.

FIGS. 4 to 8 illustrate the details of the first aligning unit 33. The unit 33 comprises a substantially U-shaped pattern or jacket 42 which is shiftable radially toward and away from the turret 32 by a mechanism 45 including a stationary guide (not shown) wherein the jacket 42 is movable back and forth. The shifting mechanism 45 further comprises a pivotable lever 44 which is mounted on a fixed shaft 43 and is articulately connected with the jacket 42 by a link 46. The jacket 42 comprises two substantially parallel plates 47 and 48 which define a compartment 49 for reception of a group of four registering pads 29. The width of the compartment 49 (as considered at right angles to the planes of the major portions of the plates 47 and 48) equals or approximates the thickness of a pad 29. The inner end portions 51, 52 of the plates 47, 48 (i.e., those end portions which are nearer to the turret 32) flare outwardly to insure unimpeded entry of a group of registering pads 29 into the compartment 49 when the jacket 42 is moved toward the axis 35 of the turret 32.

Figure 4:
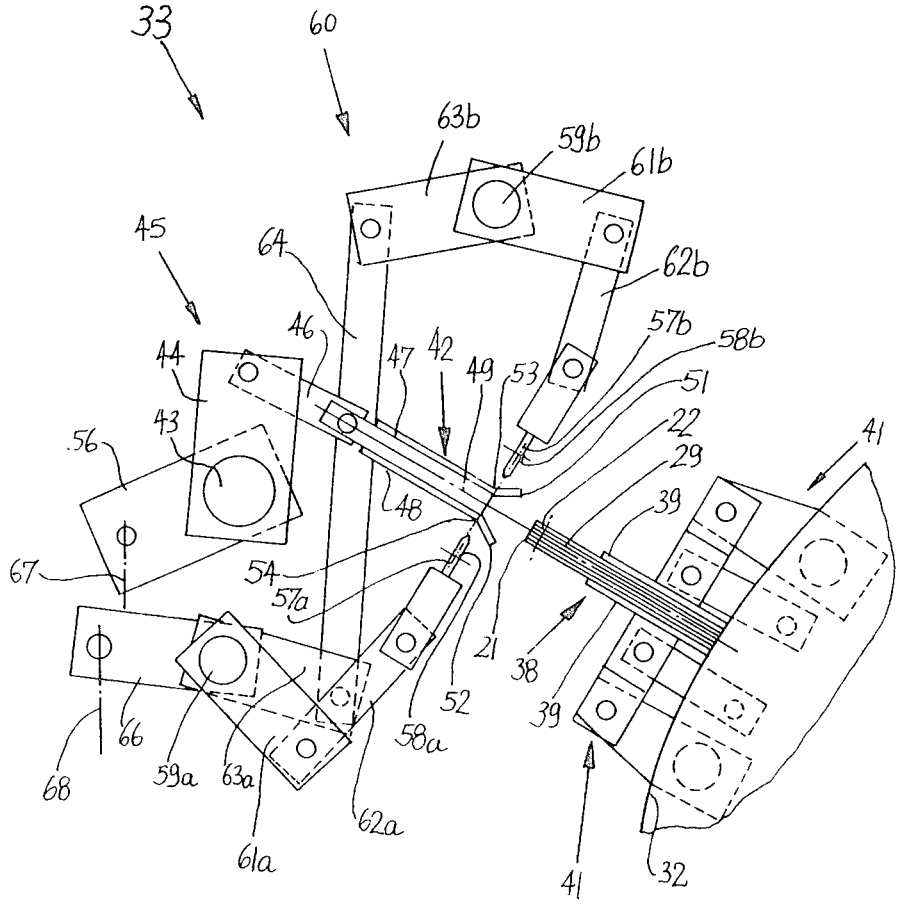
FIG. 4 illustrates the details of the first aligning unit of FIGS. 1*b* and 3*a;*
Figure 5:
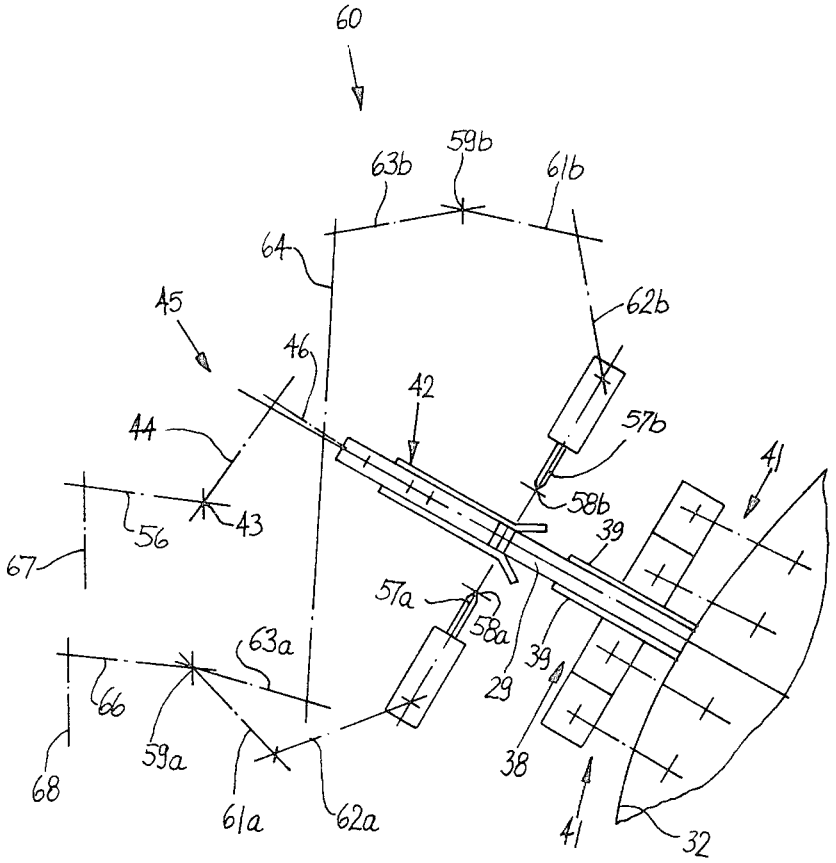
FIG. 5 is a schematic view of the aligning unit of FIG. 4, with the parts of the aligning unit shown in different positions.

The plates 47, 48 are respectively formed with rows of apertures 53, 54 which register with the perforations 22 of a group of pads 29 in the adjacent holder 38 when the jacket 42 is moved from the retracted position of FIG. 4 to the first extended position of FIG. 5. The diameters of apertures 53 and 54 preferably equal or approximate the diameters of perforations 22.

Figure 7:
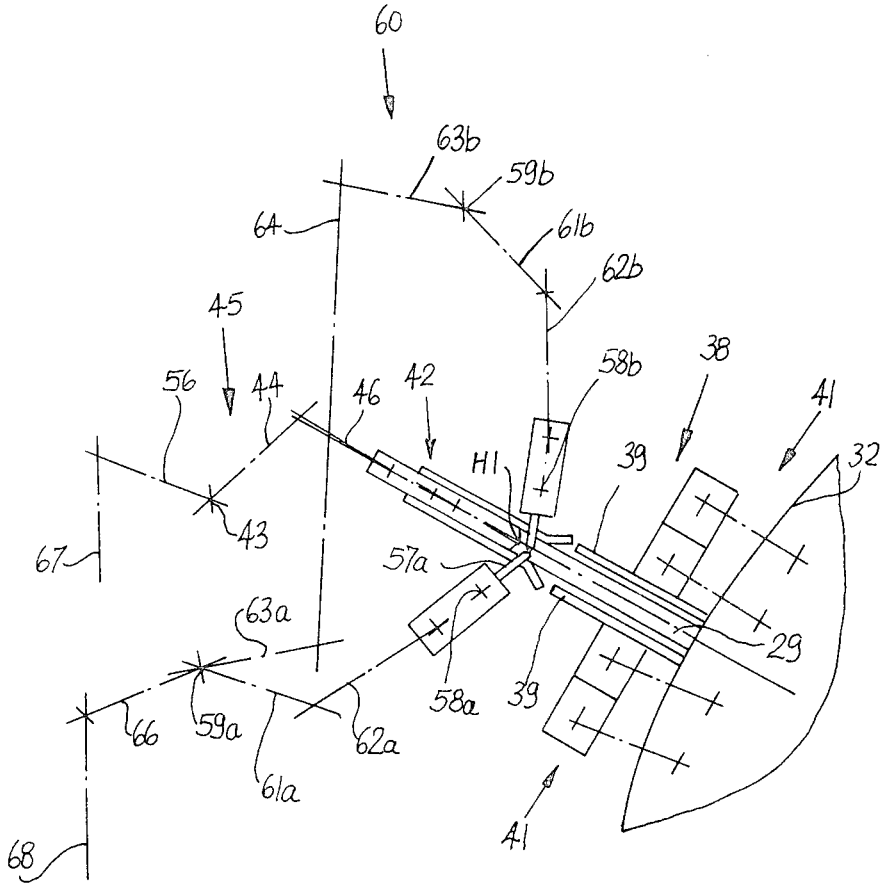
FIG. 7 illustrates the structure of FIG. 6, with the parts shown in different positions.
Figure 8:
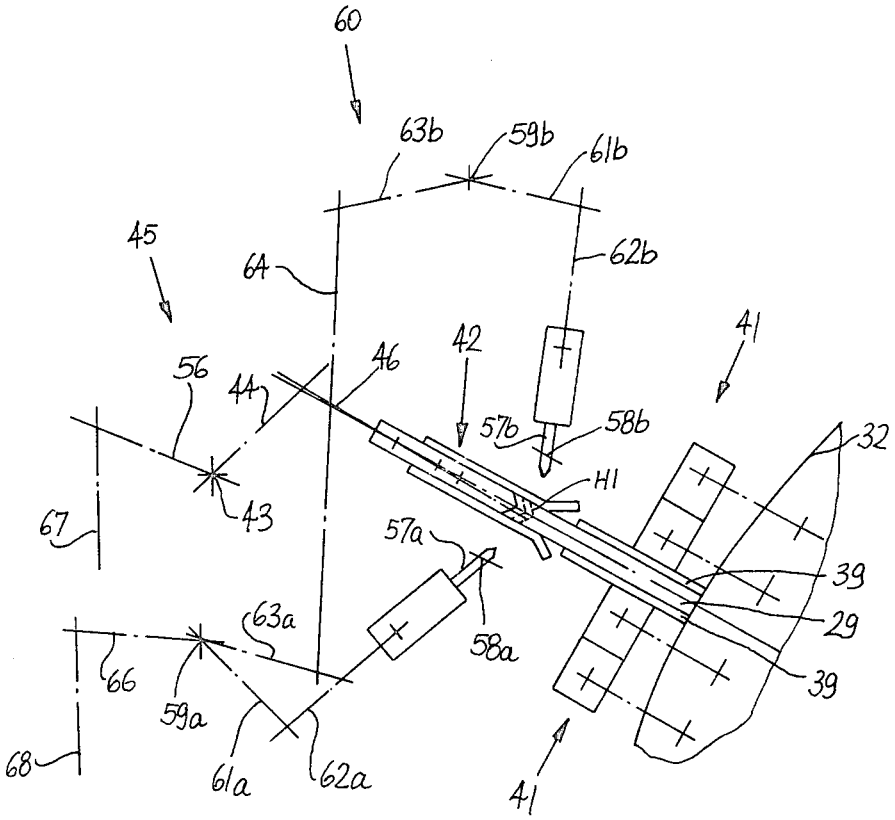
FIG. 8 illustrates the structure of FIG. 7, with the parts shown in different positions.

The means for pivoting the lever 44 of the shifting mechanism 45 back and forth to thereby move the jacket 42 between the positions of FIGS. 4 and 5 and a second extended position which is shown in FIG. 7 comprises a further lever 56 which is mounted on the shaft 43 and is rigid with the lever 44. The lever 56 is pivotable by a suitable drive means (not shown), e.g., by a drive means including a rotary cam.

The jacket 42 is flanked by two rows of pin-shaped mandrels 57*a*, 57*b* which respectively register with the apertures 54, 53 of the plates 48 and 47. The jacket 42 carries suitable guide means (not specifically shown) which confines the mandrels 57*a*, 57*b* to reciprocatory movement toward and away from the respective apertures 54, 53. Furthermore, the mandrels 57*a*, 57*b* are respectively turnable about pivot members 58*a*, 58*b*. These pivot members are or can be mounted in the just mentioned guide means of the jacket 42.

The means 60 for moving the two rows of mandrels 57*a* and 57*b* toward each other comprises levers 61*a*, 61*b* which are respectively mounted on fixed shafts 59*a*, 59*b* and are respectively coupled with the corresponding rows of mandrels by links 62*a*, 62*b*. The levers 61*a*, 61*b* are respectively rigid with levers 63*a*, 63*b* which are coupled to each other by a link 64 to insure that axial movements of mandrels 57*a* are synchronized with the movements of mandrels 57*b*. The levers 61*a*, 63*a* are rigid with a further lever 66 which receives motion from the aforementioned drive means for the lever 56, i.e., from the rotary cam. The cam transmits motion to the levers 56 and 66 by means of followers on connecting rods 67 and 68 which are indicated by phantom lines.

The cam of the drive means for the levers 56 and 66 has three raised portions or lobes to operate the first aligning unit 33 in the following way: The parts of the unit 33 assume the starting or idle positions of FIG. 4 when a holder 38 with a group of registering pads 29 approaches the position shown in FIG. 4. The turret 32 is arrested when the pads 29 in such holder 38 register with the jacket 42 (which is retracted). The aforementioned cam of the drive means for the levers 56 and 66 then causes the jacket 42 to move radially toward the turret 32 so that the apertures 53 and 54 are placed into register with the perforations 22 of the pads 29 at the first aligning station. The aforementioned guide means of the jacket 42 compels the two rows of mandrels 57*a* and 57*b* to share such movement of the jacket; however, the configuration of the cam which transmits motion to the levers 56 and 66 via followers of the connecting rods 67 and 68 is such that the angular position of the lever 66 remains unchanged while the jacket moves toward the first extended position of FIG. 5 so that the distance between the mandrels 57*a*, 57*b* and the respective plates 48, 47 of the jacket 42 increases (compare FIGS. 4 and 5). The pivot members 58*a*, 58*b* for the mandrels 57*a* and 57*b* are blocked.

Figure 6:
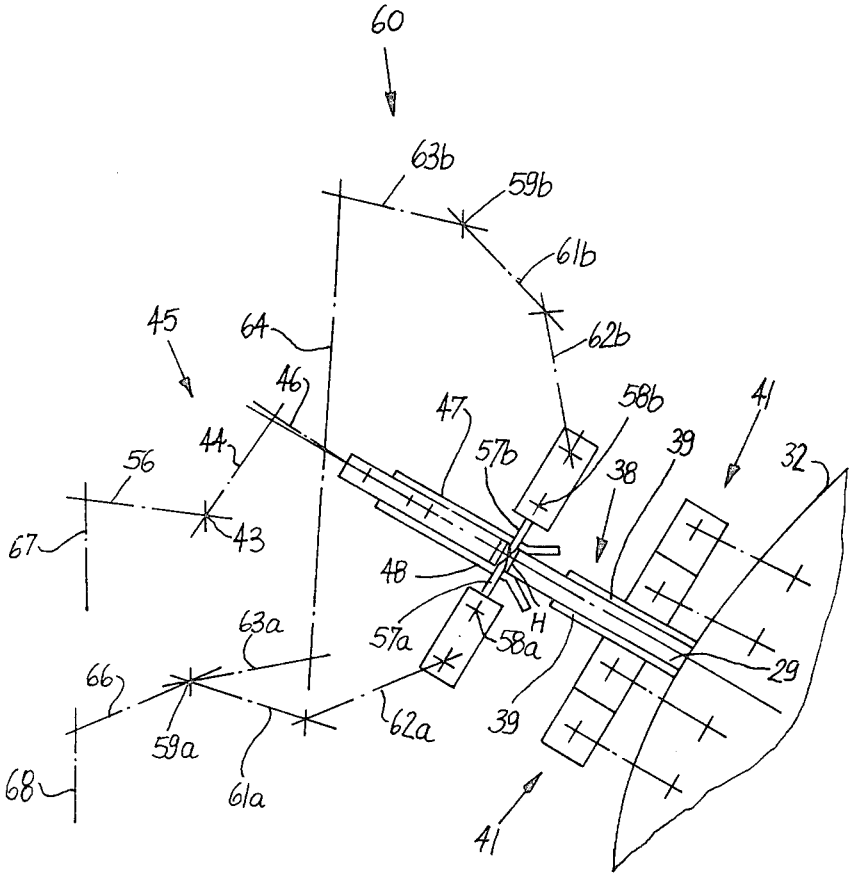
FIG. 6 illustrates the structure of FIG. 5, with the parts shown in other positions.

During the next stage of rotation of the cam which transmits motion to the connecting rods 67 and 68, the jacket 42 remains in the position of FIG. 5 and the connecting rod 68 pivots the lever 66 in a direction to move the two rows of mandrels 57*a* and 57*b* toward each other so that the tips of the mandrels penetrate into the respective perforations 22 of the pads 29 in the compartment 49. The tips of the mandrels 57*a* can actually engage (abut against) the tips of the aligned mandrels 57*b* (see FIG. 6). The pivot members 58*a*, 58*b* are released when the mandrels 57*a* and 57*b* reach the positions which are shown in FIG. 6. In FIG. 6, the registering perforations 22 of sheets of the pads 29 in the holder 38 still form straight holes (one shown at H) whose axes are normal to the planes of the sheets. The aforementioned cam for the linkage 41 of the holder 38 at the first aligning station thereupon moves the jaws 39 of the holder 38 away from each other, i.e., the pads 29 which extend into the compartment 49 of the jacket 42 are released by the holder 38 so that their sheets can be moved relative to each other in response to pivoting of the mandrels 57*a* and 57*b* from the positions of FIG. 6 to those shown in FIG. 7. Such pivoting of mandrels 57*a* and 57*b* takes place in response to pivoting of the lever 56 by the connecting rod 67 in a direction to move the jacket 42 toward the turret 32, i.e., to the second extended position. The result is that each straight hole H consisting of a series of registering perforations 22 is converted into a substantially V-shaped hole or passage H1 which is shown in FIG. 7. The configuration of each V-shaped passage H1 resembles the curvature of convolutions of a spiral 93A, i.e., the passages H1 resemble the projection of a convolution of the spiral 93A into a plane which is normal to the axis of the spiral.

The cam on the shaft of the turret 32 thereupon moves the jaws 39 of the holder 38 at the first aligning station (unit 33) toward each other so that the holder 38 engages the pads 29 and maintains the perforations 22 in the positions shown in FIG. 7. The cam for the levers 56 and 66 transmits motion to the connecting rod 68 to withdraw the mandrels 57*a* and 57*b* from the respective perforations 22 as well as from the respective apertures 54 and 53 of the jacket 42 (see FIG. 8), and such cam thereupon causes the rod 67 to pivot the lever 56 in a direction to move the jacket 42 back to the retracted position of FIG. 4. The same procedure is repeated when the next holder 38 advances to the position of register with the jacket 42.

The second aligning unit 34 comprises a comb-like aligning device 71 (hereinafter called comb for short) with a row of hook-shaped prongs 72 whose curvature and helix angle match those of the convolutions of a spiral binder 93 (shown in FIGS. 9, 10, 11, 14 and 15), i.e., the radii of curvature of the prongs 72 equal or approximate the radius of a spiral 93A and the prongs resemble portions of convolutions of a helix. The comb 71 is rigid with a gear 73 which meshes with a larger gear 74 (both gears are indicated in FIG. 3*a* by phantom lines). The gear 73 can turn back and forth about a fixed axis and the comb 71 shares such movements of the gear 73. The shaft of the gear 74 is fixedly mounted in the frame of the apparatus and the gear 74 is rigidly connected to a lever 76 which, in turn, is articulately connected to a link 77 receiving motion from a lever 79 (see FIG. 3*b*) rotatable about the axis of a fixed shaft 78. The means (e.g., a suitable cam drive) for pivoting the lever 79 back and forth at requisite intervals is not shown in the drawing.

The second aligning unit 34 further comprises a shaping or profiling block 81 which extends along the full length of a group of registering pads 29 at the second aligning station. The profiling block 81 is mounted in or on a carrier 82 which is movable toward and away from the turret 32 by a mechanism including a lever 84 mounted on a fixed shaft 83 and articulately connected to the upper end portion of the carrier 82 by a link 86. The means for pivoting the lever 84 at requisite intervals to move the profiling block 81 into and from engagement with the rear (outer) edge faces 21 of a group of registering pads 29 at the second aligning station may comprise a rotary cam or the like (not shown).

In order to insure that the outer portions of sheets forming the group of registering pads 29 at the second aligning station will be held against spreading apart during forward movement of the profiling block 81, the unit 34 further comprises two elongated pressure plates 87*a* and 87*b* which are mounted at the level of perforations 22 in the group of pads 29 at the second aligning station. The pressure plates 87*a* and 87*b* are respectively mounted on levers 88*a* and 88*b* which can be pivoted back and forth at requisite intervals by a drive 89. This drive comprises a fixed shaft 89*b*, a lever 89*a* on the shaft 89*b*, a link 89*c* which couples the lever 89*a* to the lever 88*a* and suitable means (not shown) for synchronizing the movements of the lever 88*a* with those of the lever 88*b* (however, the levers 88*a* and 88*b* move in the opposite directions). The synchronizing means is analogous to the parts 63*a*, 63*b*, 64 in the first aligning unit 33. The pressure plates 87*a* and 87*b* have suitable slots, notches, holes or other types of openings for the prongs 72 of the cam 71.

When the turret 32 is in motion, the comb 71 is retracted (to a position to the left of that shown in FIG. 3*a*), the profiling block 81 is also retracted (to a position radially outwardly of and remote from the turret 32), and the levers 88*a* and 88*b* are held in the retracted positions so that the mobile parts of the second aligning unit 34 cannot interfere with indexing of the turret 32 and its holders 38. When a holder 38 reaches the second aligning station (such holder maintains the pads 29 in the positions shown in FIG. 8) and the comb 71 is moved to the position of FIG. 3*a*, the respective linkages 41 cause the jaws 39 to move apart so that the prongs 72 of the comb 71 can deform each V-shaped hole or passage H1 (each such passage consists of a series of registering perforations 22) in a manner as shown in FIG. 3*a*, i.e., the V-shaped passages H1 are converted into arcuate holes or passages H2 whose curvature and helix angle equal or closely approximate those of the convolutions of a spiral binder 93. It is preferred to relax the pressure upon the outer sides of the outermost sheets of pads 29 at the second aligning station subsequent to entry of prongs 72 into the respective V-shaped holes or passages H1. The pressure plates 87*a* and 87*b* are moved close to or into contact with the rear or outer edge portions of the outermost sheets of pads 29 at the second aligning station not later than when the profiling block 81 moves inwardly toward the axis 35 of the turret 32 to impart to the rear or outer edge faces 21 of the pads a concave (semicylindrical) profile. The curvature of the inner end face of the profiling block 81 equals or approximates the curvature of prongs 72 and hence the curvature of a binder 93.

It is also possible to employ a stationary profiling block 81 and to provide means for moving the holder 38 at the second aligning station radially outwardly toward the block 81. All that counts is to provide means for effecting a relative movement between the inserted prongs 72 and the sheets of the pads 29 at the second aligning station so as to convert each V-shaped passage H1 into an arcuate passage H2 having a helix angle equal to that of the spiral 93A.

An advantage of the arrangement including the aligning units 33, 34 and the turret 32 with its holders 38 is that the sheets of the pads 29 can be formed with relatively small perforations 22. This is due to the fact that the first aligning unit 33 converts each substantially straight hole H (consisting of a series of registering perforations 22) into a V-shaped hole or passage H1 whose configuration approximates or resembles that of an arcuate prong 72. Therefore, the prongs 72 at the second aligning station can be readily inserted into the respective V-shaped passages H1 even if the diameters of perforations 22 are relatively small.

Furthermore, multi-stage conversion of each substantially straight hole H into an arcuate passage H2 whose configuration is best suited to receive a portion of a convolution forming part of a spiral 93A is especially desirable when the pads are relatively thick, either because they comprise a large number of leaves or because the leaves are rather thick. It can be said that the first stage involves a coarse alignment which results in conversion of straight holes H into passages H1 suited for insertion of arcuate prongs, and that the second stage involves a final or high-precision adjustment which insures that the leader of the spiral 93A does not become stuck during threading of the spiral into a group of registering pads at the station for the spiral inserting unit 36.

The jacket 42 of the first aligning unit 33 performs several useful functions, namely, it supports and moves the two rows of mandrels **57*a*, 57*b* toward and from positions of register with the respective holes of pads 29 at the first aligning station, its apertures 53 and 54 guide the tips of the mandrels 57*a*, 57*b* into the respective straight holes H from opposite sides of pads 29 at the first aligning station, its compartment 49 prevents undue spreading of leaves of the pads 29 when the jaws 39 of the holder 38 at the first aligning station are moved apart to relax the pressure upon the unperforated portions of outermost leaves of the pads, and it pivots the mandrels during movement from the extended position of FIGS. 5 and 6 to the second extended position of FIG. 7 whereby the mandrels convert each straight hole H into a V-shaped passage H1**.

The spiral introducing unit 36 includes a conventional coiling device 91 which converts straight metallic or plastic wire into a spiral 93A. The coiling device 91 is adjacent to the outer edge faces of pads 29 which reach the spiral inserting station (see FIG. **3*b*). The unit 36 further comprises two abutments 92*a*, 92*b* which flank the path of movement of the leader of a spiral 93A into and out of successive sets of perforations 22 (the spiral 93A rotates about its own axis which is normal to the plane of FIG. 3*b*); these abutments extend along the full length of a group of registering pads 29 at the spiral inserting station and are preferably provided with suitable notches, recesses or analogous guide means for the helices of the spiral 93A. The abutments 92*a*, 92*b* are mounted at the free ends of two levers 92A, 92B which are pivotable about the axes of fixed shafts 94*a*, 94*b* so that they can be moved out of the way when a group of registering pads 29 advances toward or away from the spiral inserting station. The means for pivoting the levers 92A and 92B is similar or analogous to the parts 63*a*, 63*b*, 64 of the first aligning unit 33**.

The coiling device 91 of the spiral inserting unit 36 is preferably driven by a discrete prime mover 96, e.g., a variable-speed electric motor. The mode of operation of the spiral inserting device 36 is known in the art; therefore, a detailed description of the manner in which the spiral 93A is formed and threaded into the pads 29 at the station for the unit 36 is not necessary.

Figure 9:
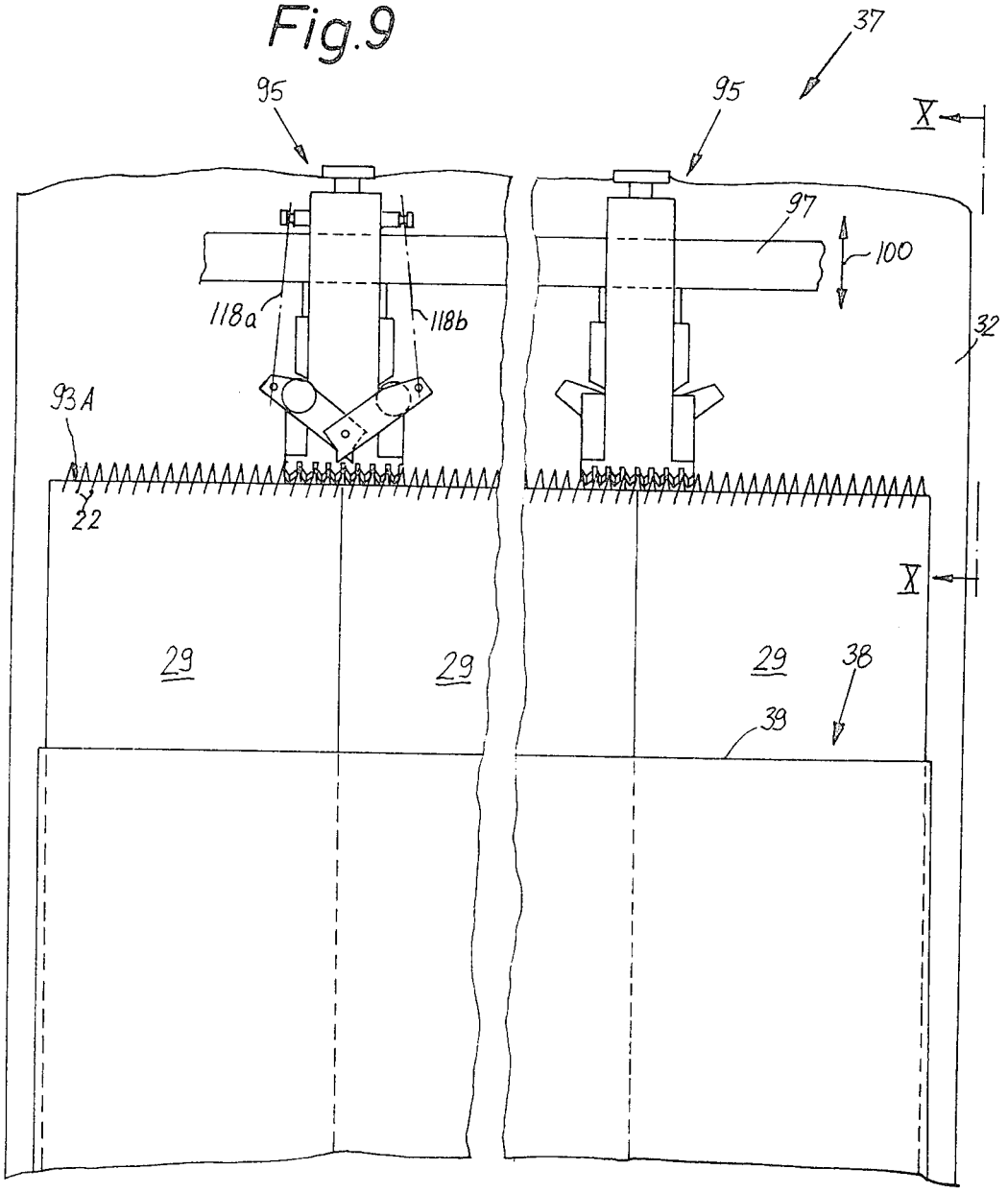
FIG. 9 is an enlarged fragmentary view as seen in the direction of arrows from the line IX—IX of FIG. 1*b;*

The construction of the trimming or severing and deforming unit 37 is shown in detail in FIGS. 9 to 13. FIG. 9 merely shows two of the three trimming or severing and deforming devices or tools 95 which are provided to sever and deform a spiral 93A at the trimming station in order to convert such spiral into four discrete binders 93. The unit 37 further comprises two additional trimming devices or tools (not shown) which merely bend or bend and loop the free ends of the spiral 93A at the trimming station. The construction of such additional trimming tools is similar to but simpler than that of the tools 95 because each additional tool must trim (if necessary) and bend or bend and loop only one end portion of that length of wire which forms a spiral 93A.

The trimming devices or tools 95 are mounted on a common supporting bar 97 which is movable in directions indicated by a double-headed arrow 100, i.e., toward and away from a spiral 93A at the trimming station. An elongated adjusting or displacing member 101 is provided to impart movements to mobile parts of the trimming tools 95 so that the tools can sever the spiral 93A and bend the end portions (namely, portions of the outermost convolutions) of the resulting binders 93. The displacing member 101 receives motion from a lever 99 (see FIG. **3*b*) mounted on a fixed shaft 98 and articulately connected to the member 101 by one or more links 102**.

Figure 10:
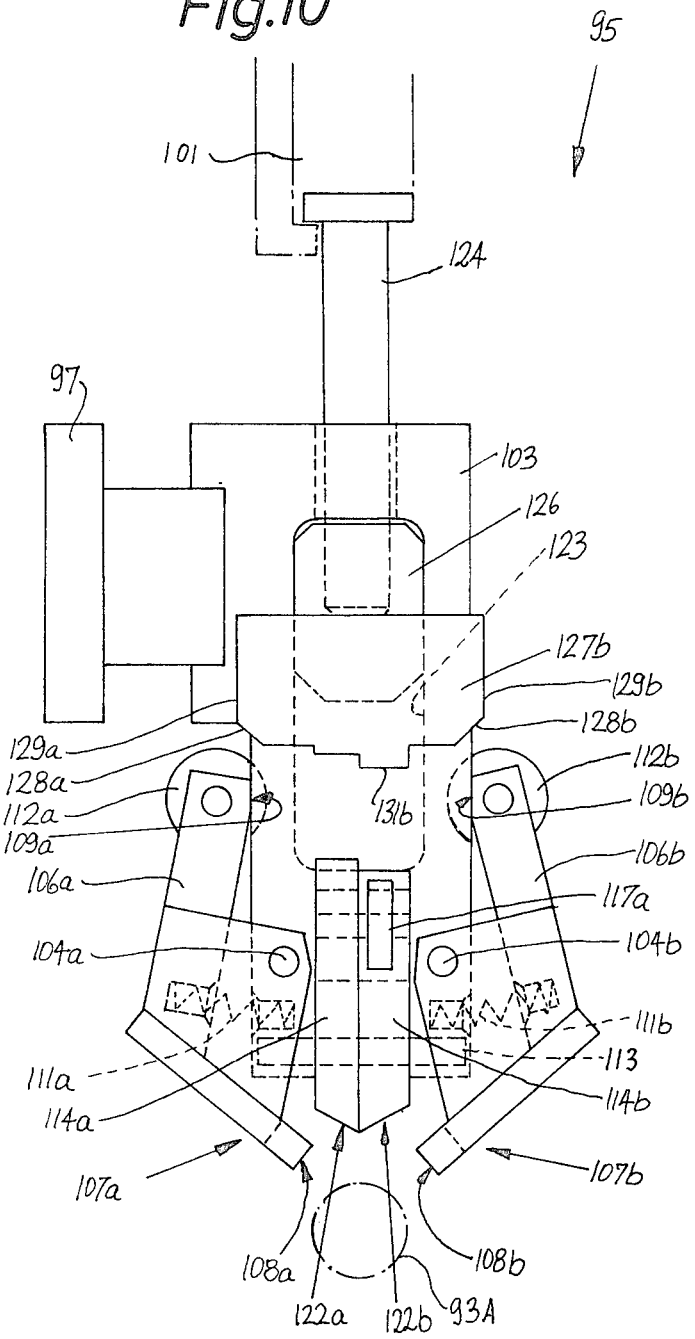
FIG. 10 is an enlarged view as seen in the direction of arrows from the line X—X of FIG. 9, with the note books omitted.

Each trimming device or tool 95 comprises a carriage or support 103 which is secured to the supporting bar 97 and includes two pivot members or shafts **104*a*, 104*b* for bell crank levers 106*a*, 106*b*. The levers 106*a*, 106*b* constitute a means for positioning or locating the convolutions of the spiral 93A by means of spaces 110 between their teeth 108*a*, 108*b*. These teeth are provided at the free ends of lower arms or jaws 107*a*, 107*b* of the respective bell crank levers. The inclination and distribution of the tooth spaces 110 correspond to the distance between and the lead of helices of the spiral 93A. The upper arms of the bell crank levers 106*a*, 106*b* have facetted portions 109*a*, 109*b* which normally abut against the carriage 103. The levers 106*a*, 106*b* are respectively biased by helical springs 111*a*, 111*b* which react against the carriage 103 and tend to maintain the facetted portions 109*a*, 109*b* in abutment with the respective side faces of the carriage. The idle positions of the bell crank levers 106*a* and 106*b* are shown in FIG. 10. It will be noted that the toothed lower arms 107*a*, 107*b* are spaced apart from the convolutions of the spiral 93A. The upper arms of the levers 106*a*, 106*b* respectively carry roller followers 112*a*, 112*b***.

The axes of the shafts **104*a*, 104*b* for the bell crank levers 106*a*, 106*b* are parallel to the axis of the spiral 93A at the trimming station. The carriage 103 further includes or supports a pivot member or shaft 113 whose axis is normal to the axis of the spiral 93A. The shaft 113** supports two levers 114*a*, 114*b* which constitute the sections or halves of a cutting implement or shears for the wire of the spiral 93A. The cutting edges 116*a*, 116*b* of the sections or levers 114*a*, 114*b* sever the wire when the levers are pivoted toward each other from the positions of FIG. 12 to those shown in FIG. 13. The cutting edges 116*a*, 116*b* are provided on the shorter lower arms of the levers 114*a*, 114*b*; the longer upper arms of these levers carry roller followers 117*a*, 117*b*. Furthermore, the free ends of the upper arms of the levers 114*a*, 114*b* are connected to helical springs 118*a*, 118*b* (shown in FIGS. 9, 12 and 13) whose upper ends are attached to posts 119*a*, 119*b* of the carriage 103. The springs 118*a*, 118*b* tend to move the cutting edges 116*a*, 116*b* on the lower arms of the levers 114*a*, 114*b* away from each other.

Figure 12:
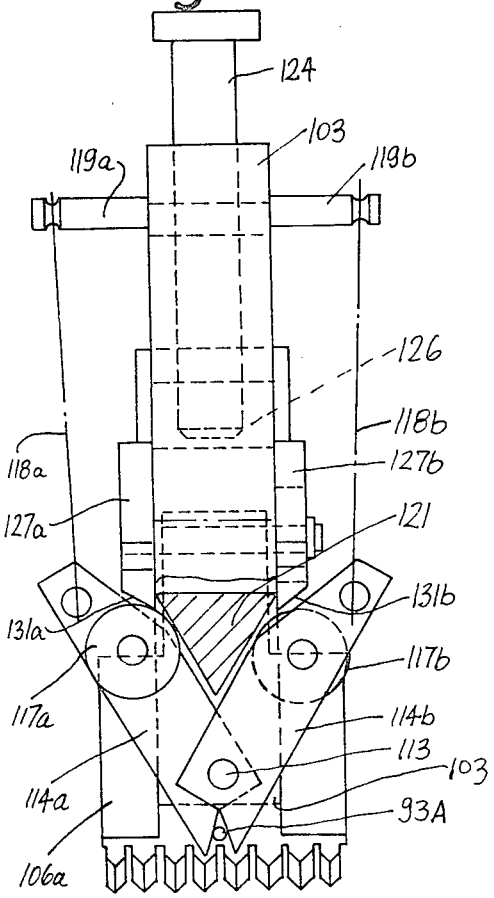
FIG. 12 is an enlarged view of one of the spiral severing units in FIG. 9.
Figure 13:
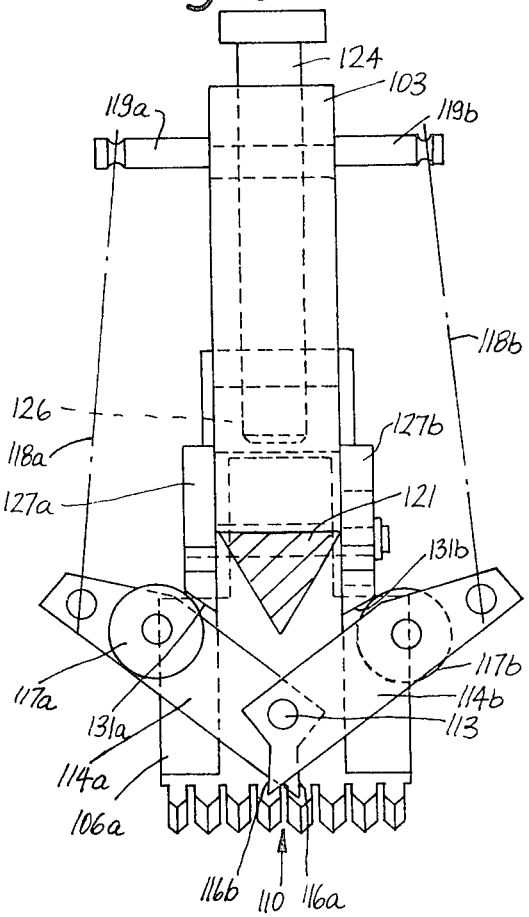
FIG. 13 illustrates the structure of FIG. 12, with the parts shown in different positions.

When the levers 114*a*, 114*b* dwell in the inoperative positions of FIG. 12, their roller followers 117*a*, 117*b* abut against the respective inclined faces of a wedge-like auxiliary cam 121 which is secured to or forms part of the carriage 103. That portion of the carriage 103 which supports or includes the auxiliary cam 121 is bifurcated. The cutting edges 116*a*, 116*b* assume positions in which the wire of the spiral 93A can be moved therebetween preparatory to severing.

In addition to performing a severing operation, the lower arms of the sections or levers 114*a*, 114*b* further serve to deform or bend the free end portions of the adjacent binders 93 which are obtained on severing of the spiral 93A. To this end, the lower arms of the levers 114*a*, 114*b* are respectively provided with wire deforming portions or shoulders 122*a*, 122*b* which are adjacent to the respective cutting edges 116*a*, 116*b*. When the toothed jaws 107*a*, 107*b* of the bell crank levers 106*a*, 106*b* are closed to engage the adjacent convolutions of the spiral 93A, the deforming portions 122*a*, 122*b* are parallel to the respective jaws (see FIG. 11).

The carriage 103 further includes guide means or ways 123 for a reciprocable slide 126 which is connected to the displacing member 101 by means of a plunger or rod 124. The displacing member 101 can move the slide 126 toward or away from the spiral 93A at the trimming station. The slide 126 has suitably configurated cams 127*a* and 127*b* for the roller followers 112*a*, 112*b* of the bell crank levers 106*a*, 106*b*. The cams 127*a*, 127*b* respectively include inclined first cam faces 128*a*, 128*b* and second cam faces 129*a*, 129*b* which are parallel to each other and adjacent to the respective first cam faces. In addition, the cams 127*a* and 127*b* comprise cam faces 131*a* and 131*b* for the roller followers 117*a*, 117*b* of the levers 114*a*, 114*b*. The slide 126, its cams 127*a*, 127*b* and the rod 124 can be said to constitute a means for moving the toothed jaws 107*a*, 107*b* into engagement with the convolutions of the spiral 93A as well as for moving the cutting edges 116*a*, 116*b* (and hence also the shoulders 122*a*, 122*b*) toward each other. The jaws 107*a*, 107*b* move apart under the action of the springs 111*a*, 111*b*, and the lower arms of the levers 114*a*, 114*b* move apart under the bias of the springs 118*a*, 118*b*.

An important advantage of the improved tools 95 is that they can sever and deform the material of successive spirals 93A between pairs of immediately adjacent pads 29, i.e., it is not necessary to move the pads away from each other prior to introduction of a spiral in order to provide room for movement of tools 95 to their operative positions in which the cutting edges 116*a*, 116*b* can sever the wire and the shoulders 122*a*, 122*b* can deform the thus obtained end portions 93B while the convolutions at both sides of the severing plane are engaged by the toothed portions 107*a*, 107*b* of the levers 106*a*, 106*b*. In other words, each tool 95 can replace two conventional tools which are used to sever a spiral at two spaced-apart points between two registering pads which have been moved apart for the express purpose of enabling the conventional tools to perform the severing operations. Moreover, and as mentioned above, each tool 95 can sever a spiral 93A without any waste in the material of the spiral.

Figure 11:
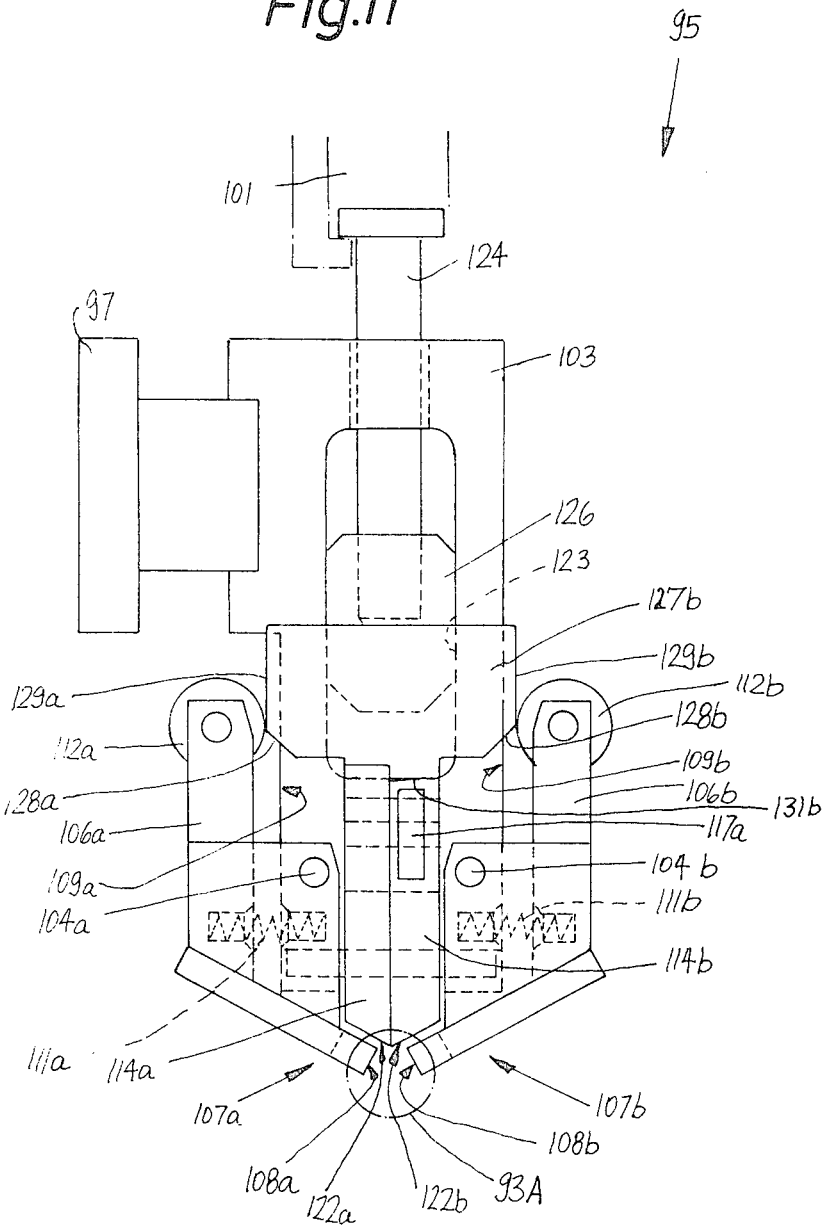
FIG. 11 illustrates the structure of FIG. 10, with the parts shown in different positions.

The operation of the trimming or severing and deforming device or tool 95 which is shown in FIGS. 10 to 13 is as follows:

FIG. 10 illustrates the parts of the tool 95 in their starting or idle positions. Thus, the toothed jaws 107*a*, 107*b* of the bell crank levers 106*a*, 106*b* and the lower arms of the sections or levers 114*a*, 114*b* are remote from the spiral 93A. The supporting bar 97 thereupon moves the support or carriage 103 toward the spiral 93A so that a portion of the spiral extends between the cutting edges 116*a*, 116*b* when the carriage 103 reaches its inner end position which is shown in FIG. 11. The cutting edges 116*a*, 116*b* thereby perform at least some centering action upon the adjacent portion of the spiral 93A. In the next step, the displacing member 101 is moved toward the turret 32 to move the slide 126 along the ways 123 through the medium of the plunger 124. The faces 128*a*, 128*b* of the cams 127*a*, 127*b* cause the roller followers 112*a*, 112*b* to pivot the bell crank levers 106*a*, 106*b* against the opposition of the respective springs 111*a*, 111*b* whereby the toothed jaws 107*a*, 107*b* move toward the spiral 93A and the tooth spaces 110 receive portions of the adjacent convolutions. This insures that the spiral 93A is properly located for the severing and deforming operations which follow. The jaws 107*a*, 107*b* thereupon remain in their operative positions (in which the convolutions of the spiral 93A extend into the tooth spaces 110) because the roller followers 112*a*, 112*b* begin to track the parallel cam faces 129*a*, 129*b* of the moving cams 127*a*, 127*b*.

Figure 14:
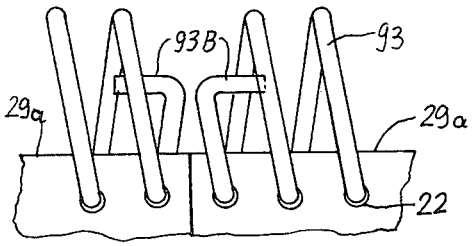
FIG. 14 is an enlarged fragmentary side elevational view of two neighboring note books whose sheets or leaves are held together by discrete spiral binders.
Figure 15:
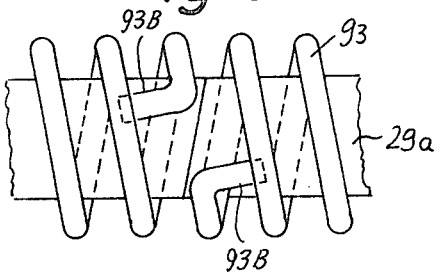
FIG. 15 is a plan view of the note books of FIG. 14.

As the slide 126 continues to move toward the axis 35 of the turret 32, the faces 131*a*, 131*b* of the cams 127*a*, 127*b* reach and displace the roller followers 117*a*, 117*b* of the levers 114*a*, 114*b* whereby the cutting edges 116*a*, 116*b* move toward each other and sever the wire of the spiral 93A. The downward or inward movement of the slide 126 continues, i.e., the levers 114*a*, 114*b* continue to pivot whereby their shoulders 122*a*, 122*b* deform the adjacent end portions of the resulting binders 93. As shown in FIGS. 14 and 15, the end portions 93B of the binders 93 are bent toward each other in such a way that they extend in parallelism or substantial parallelism with the axes of the respective binders. In deforming the end portions 93B, the shoulders 122*a*, 122*b* cooperate with the teeth 108*a*, 108*b* of the respective jaws 107*a*, 107*b*.

The displacing member 101 thereupon moves the slide 126 away from the turret 32, and such movement of the displacing member 101 is followed by upward movement of the supporting bar 97 to return all parts of the tool 95 to the positions shown in FIG. 10. This enables the turret 32 to perform an angular movement in a direction to place the next group of registering pads 29 (with a spiral 93A) into requisite position with respect to the tools 95. The finished pads 29*a* are transported to the take-off station TO for detachment from the respective holder 38 and for transport to storage, to a conveyance or to a further processing station.

The just described method and apparatus exhibit a number of important advantages over the aforediscussed conventional automatic and semiautomatic methods and apparatus. Thus, all units of the apparatus can be disposed in a single line, one behind the other, as considered in the direction of transport of sheets 7 and pads 29, because the path along which the sheets and pads move is bounded by two parallel planes (these planes are indicated in FIG. 2*a* by the phantom lines X—X and Y—Y). Moreover, and since the perforating unit 16 extends transversely of the direction of movement of stacks 6*a* along the planar first section 1 of the path (in the illustrated embodiment, the first section 1 is located in a horizontal plane), the step of perforating the sheets 7 of successive stacks 6*a* takes up a very short interval of time regardless of the length of the sheets 7, i.e., regardless of whether each sheet 7 is dimensioned to yield two, three, four, five, six or more leaves of a pad 29. The length of each step which is performed by the stacks 6, 6*a*, 6*b* and groups of registering pads 29 need not exceed the length of steps which must be performed in conventional apparatus, namely, in apparatus which are designed to produce a single file of pads.

The improved method and apparatus are more economical than the aforediscussed conventional methods and apparatus because the material of the metallic or plastic wire which is used for the making of spirals 93A can be processed without any or with negligible waste. This is due to the fact that the pads 29 of each group at the station for the spiral introducing unit 36 are immediately adjacent to each other, i.e., the spiral 93A is merely severed in regions between neighboring pads 29 of a group and such severing does not or need not entail any waste in the material of the spiral.

The provision of transporting means which includes at least one indexible turret is advantageous because this reduces the overall length of the apparatus, i.e., the overall length of the path along which the constituents of finished pads 29*a* travel from the feeding station 3 to the take-off station TO. The bending of end portions 93B of discrete binders 93 is desirable and advantageous because such deformation of the end portions insures that the end convolutions are not likely to leave the perforations of the respective pads 29*a*. As mentioned above, the end portions 93B are preferably deformed in such a way that they extend in parallelism with the axes of the respective binders 93 and that their tips face each other. In addition, the bending of end portions 93B reduces the likelihood of injury to the hands of persons using the pads 29*a*, to personnel in the manufacturing plant and/or to workmen in charge of stacking, storing, transporting and/or distributing the pads.

The feature that the second section 2 of the path is defined by an indexible conveyor is desirable and advantageous on the additional ground that the aligning units 33, 34, the spiral inserting unit 36 and the severing and deforming unit 37 can be fixedly mounted adjacent to the path of movement of holders 38.

The various mechanisms and drives for imparting movements to the transporting means as well as to the mobile components of various units can be of conventional design. Furthermore, the apparatus can be equipped with suitable means for monitoring the movements of components of the pads 29*a* and for producing signals in response to detection of eventual malfunctions. The exact construction of the drives and monitoring means forms no part of the present invention.

The apparatus of the present invention can embody means for moving the registering pads of successive groups apart, e.g., for the purpose of enabling suitable tools to provide the pads with rounded corners or for other purposes. In other words, the sheets 7 and the pads 29 are confined to movement along the aforementioned path between the planes X—X and Y—Y while they undergo those treatments which were described above, namely, assembly of stacks 6, conversion of stacks 6 into stacks 6*a*, perforation of stacks 6*a*, conversion of stacks 6*a* into stacks 6*b*, alignment of perforations 22 in successive groups of registering pads 29, introduction of spirals 93A into successive groups of registering pads 29, severing or trimming of spirals 93A and, if desired, bending of end portions 93B of the thus obtained binders 93.

Figure 16:
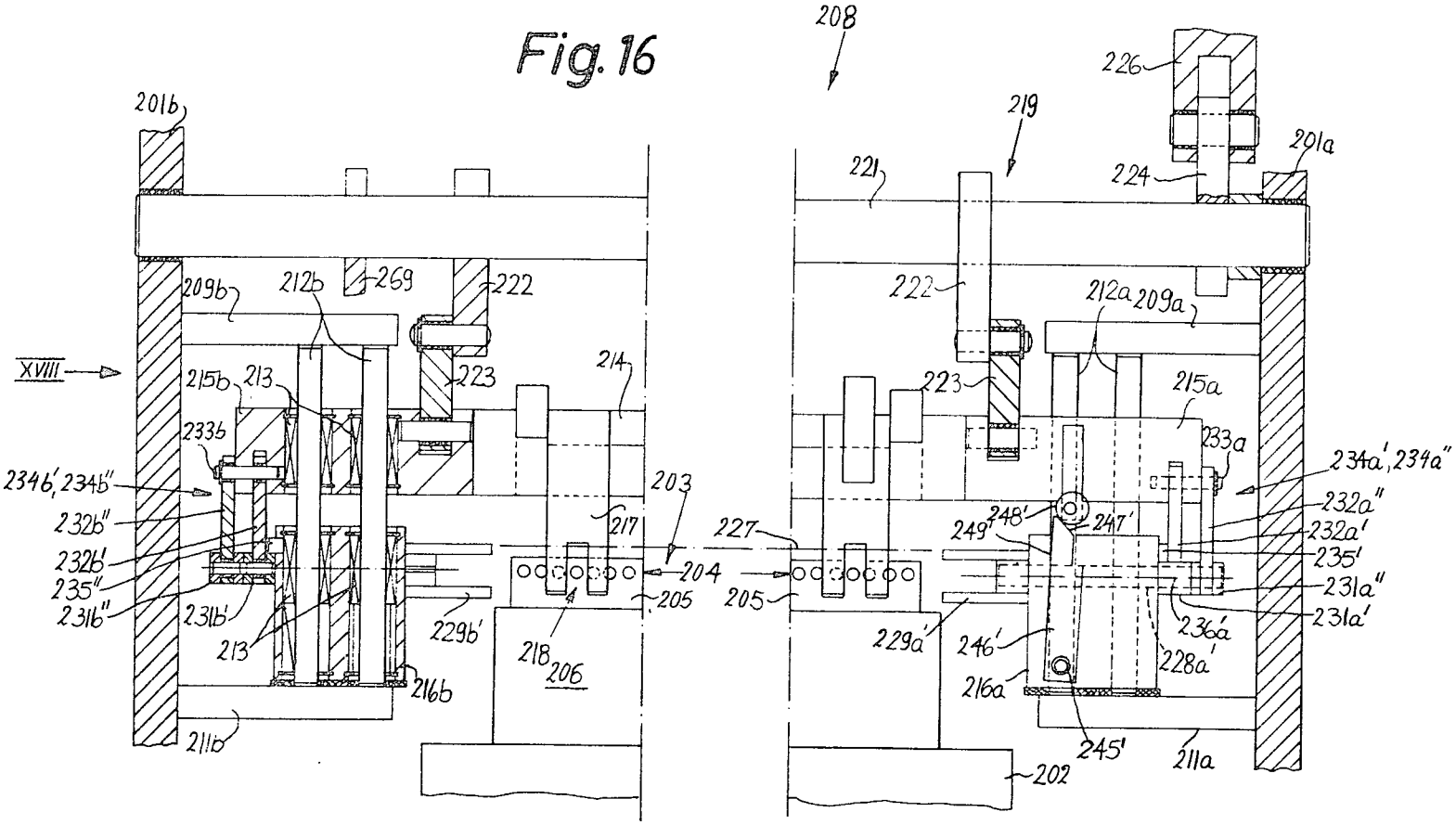
FIG. 16 is a partly side elevational and partly sectional view of a second arrangement which converts straight holes into V-shaped passages in planes making an oblique angle with the rows of perforations in the sheets of note books.
Figure 17:
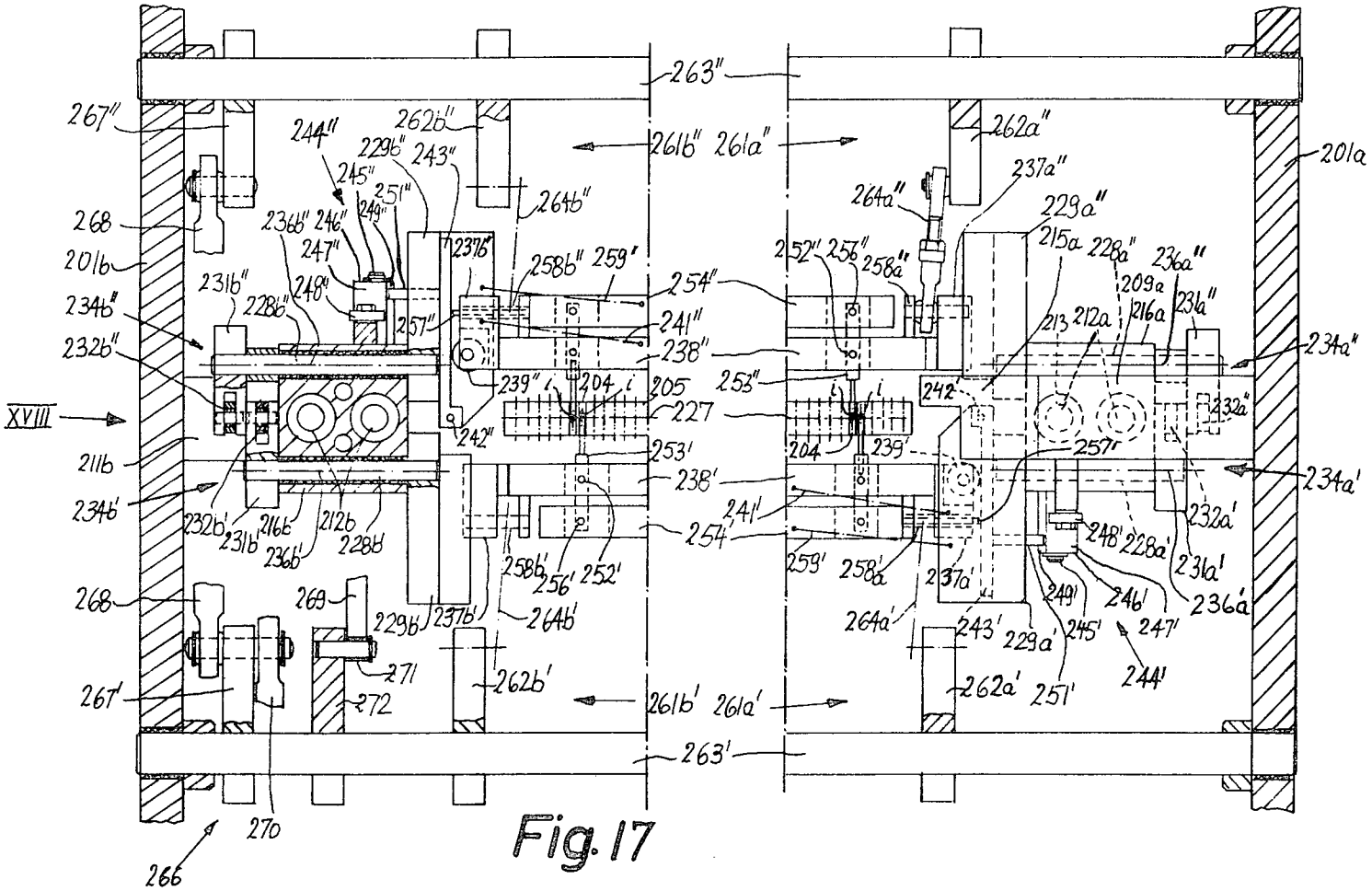
FIG. 17 is a plan view of the second arrangement, with certain parts shown in section.
Figure 18:
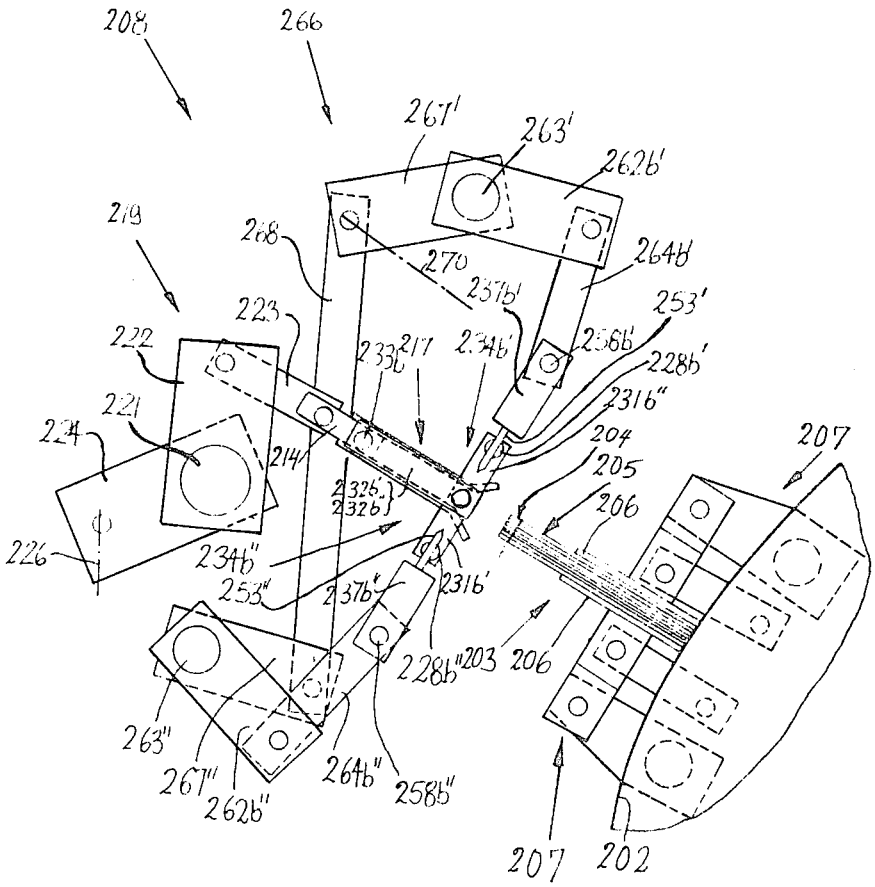
FIG. 18 is a schematic end elevational view of the second arrangement, substantially as seen in the direction of arrow XVIII in FIG. 16 or 17.

FIGS. 16, 17 and 18 show a modified aligning unit 208 which replaces the aligning units 33 and 34 of the apparatus shown in FIGS. 1 to 15. The frame of the apparatus comprises two spaced-apart parallel side walls 201*a*, 201*b* which respectively carry plate-like brackets 209*a*, 211*a* and 209*b*, 211*b* for guide members in the form of pairs of tie rods 212*a* and 212*b*. The tie rods 212*a* and 212*b* respectively serve to guide carriers 215*a*, 215*b* for a jacket or pattern 214. The carriers 215*a*, 215*b* comprise bearing sleeves 213 which slidably surround the respective tie rods 212*a*, 212*b*. Additional or auxiliary carriers 216*a*, 216*b* for mandrels 253', 253" are respectively mounted on and slidable along the tie rods 212*a*, 212*b*. The jacket 214 comprises bifurcated portions or forks 217 which define a compartment for perforated portions of pads because their prongs can flank one or more note books or pads 205 (see FIG. 19*a*). The bifurcated portions or forks 217 have apertures or notches 218 for the pin-shaped mandrels 253' and 253". The means for moving the jacket 214 along the tie rods 212*a*, 212*b* comprises a crank drive 219 including a shaft 221 which is journalled in the side walls 201*a*, 201*b* and carries two crank arms or levers 222 which are rigidly secured thereto. The free end portions of the crank arms 222 are articulately connected with links 223 which are further articulately connected to the jacket 214. The means for rotating the shaft 221 back and forth comprises a further lever 224 which is rigidly connected to the shaft 221 and is driven by a motion transmitting rod 226. The latter receives motion from a prime mover (not shown) by way of a suitable cam, preferably a cam which can move the holder 214 in three stages.

As shown in FIGS. 17 and 18 (the jacket 214 and its drive means are omitted in FIG. 17 for the sake of clarity), the carriers 216*a*, 216*b* respectively support pairs of shafts 228*a*', 228*a*" and 228*b*', 228*b*" whose axes are parallel to the axis 227 of the spiral which is to be threaded into the holes or perforations 204 of the pad or pads 205. The shafts 228*a*', 228*a*" and 228*b*', 228*b*" respectively carry, at one of their ends, guides 229*a*', 229*a*" and 229*b*', 229*b*". The other ends of the shafts 228*a*'-228*b*" are respectively rigidly connected with crank arms or levers 231*a*', 231*a*" and 231*b*', 231*b*". The levers 231*a*'-231*b*" are respectively coupled to levers 232*a*', 232*a*" and 232*b*', 232*b*". The levers 232*a*', 232*a*" are connected to the carrier 215*a* by a shaft 233*a*, and the levers 232*b*', 232*b*" are connected to the carrier 215*b* by a shaft 233*b* (see also FIG. 16). The just described levers serve as a means (designated by reference characters 234*a*', 234*a*" and 234*b*', 234*b*") for converting relative movements of carriers 215*a*, 216*a* and 215*b*, 216*b* into pivotal movements of guides 229*a'*, 229*a''*, 229*b'*, 229*b''* about the axes 236*a'*, 236*a''*, 236*b'*, 236*b''* of the respective shafts 228*a'*, 228*a''*, 228*b'*, 228*b''*. The converting means 234*a'* and 234*b'* further constitute means for respectively coupling the carriers 215*a* and 215*b* with the carriers 216*a* and 216*b*. This is due to the provision of stops 235' and 235'' which respectively limit the upward or outward movements of levers 231*a'* and 231*b'*. Thus, when the carriers 215*a* and 215*b* move upwardly, as viewed in FIG. 16, they respectively entrain the carriers 216*a* and 216*b* via motion converting means 234*a'* and 234*b'*. The brackets 211*a* and 211*b* respectively serve as stops for the carriers 216*a* and 216*b* during relative movement of carriers 215*a*, 216*a* and 215*b*, 216*b*.

The parts 229*a'*-229*b''* respectively guide slides 237*a'*, 237*a''*, 237*b'*, 237*b''*. The slides 237*a'* and 237*b'* are connected to the end faces of a first support here shown as a rod 238', and the slides 237*a''*, 237*b''* are connected to the end faces of a second rod or support 238''. The slides 237*a'*, 237*b''* respectively carry rollers 239', 239'' which are respectively biased against elongated cams 243', 243'' by springs 241', 241''. The spring 241' is connected to the guide 229a' and rod 238', and the spring 241'' is connected to the guide 229b'' and rod 238''. The cams 243' and 243'' are respectively pivotable on shafts 242', 242'' whose axes are normal to the axis 227 of the spiral. The shafts 242', 242'' are respectively mounted in the guides 229*a'*, 229*b''*, i.e., the cams can be said to constitute mobile portions of the guides 229*a'*, 229*b''*. The means (244' and 244'') for adjusting the angular positions of cams 243', 243'' respectively comprise levers 246', 246'' which are respectively mounted on shafts 245', 245''; these shafts are respectively installed in the carriers 216*a* and 216*b*. The levers 246', 246'' are respectively formed with inclined end faces 247', 247'' which engage rollers 248', 248''; these rollers are respectively mounted on the carriers 215*a*, 215*b* for the jacket 214. The levers 246', 246'' are further respectively formed with faces 249', 249'' which engage pins 251', 251'' respectively mounted in guides 229*a'*, 229*b''*.

The rods 238', 238'' respectively carry the mandrels 253', 253'' which are pivotable on shafts 252', 252''. The mandrels 253', 253'' are further respectively connected to supports here shown as rods 254', 254'' which are respectively parallel to the supports or rods 238', 238''. To this end, the mandrels 253', 253'' respectively carry pivot members 256', 256'' mounted in the corresponding rods 254', 254''. The rods 254', 254'' respectively comprise pins 257', 257'' which extend into hollow shafts 258*a'*, 258*b''* of the slides 237*a'*, 237*b''*. The free ends of the pins 257', 257'' respectively abut against the cams 243', 243''. The pins 257', 257'' are respectively biased against the cams 243', 243'' by helical springs 259', 259''. The spring 259' is connected to the guide 229*a'* and rod 254', and the spring 259'' is connected to the guide 229*b''* and rod 254''. The slides 237*a''* and 237*b'* respectively carry hollow shafts 258*a''* and 258*b'*; these shafts are respectively aligned with the shafts 258*b''* and 258*a'*.

The means for respectively reciprocating the supports or rods 238', 238'' in the guides 229*a'*, 229*b'* and 229*a''*, 229*b''* comprises two pairs of crank drives 261*a'*, 261*b'* and 261*a''*, 261*b''* which respectively include crank arms or levers 262*a'*, 262*b'* and 262*a''*, 262*b''*. The levers 262*a''*, 262*b'* are fixed to a shaft 263' which is journalled in the side walls 201*a*, 201*b*, and the levers 262*a''*, 262*b''* are fixed to a shaft 263'' which is also journalled in the side walls 201*a*, 201*b*. The levers 262*a'*, 262*b'* and 262*a''*, 262*b''* are further respectively connected with the shafts 258*a'*, 258*b'*, 258*a''*, 258*b''* of slides 237*a'*, 237*b'*, 237*a''*, 237*b''* by connecting rods 264*a'*, 264*b'*, 264*a''*, 264*b''*. The end portions of the connecting rods 264*a'*-264*b''* are provided with universal joints which enable these rods to swivel relative to the associated levers 262*a'*-262*b''* and associated shafts 258*a'*-258*a''*. This is necessary in order to enable the connecting rods 264*a'*-264*b''* to follow pivotal movements of the supports or rods 238' and 238''. The four crank drives 261*a'*-261*b''* can be said to constitute a unitary driving assembly 266 because the shaft 263' fixedly carries a lever 267' and the shaft 263'' fixedly carries a lever 267''. The levers 267', 267'' are connected to each other by a rod 268. The lever 267' is further articulately connected with a motion transmitting rod 270 which receives motion from a prime mover, e.g., a prime mover which drives a cam for a roller follower on the rod 270. Such cam can be rigidly connected to and rotated together with the aforementioned cam for the connecting rod 226. The parts 267', 267'' and 268 synchronize the movements of mandrels 253', 253'' in directions toward and away from the registering holes 204.

The pointed tips of the mandrels 253', 253'' move away from or toward each other when the mandrels 253' and 253'' respectively move about the shafts 236*a'*, 236*b'* and 236*a''*, 236*b''*. Such movements are synchronized by a control cam 269 which is affixed to the shaft 221 and engages, at times, a roller 271 on a lever 272 which is secured to the shaft 263'.

An advantage of the feature that the mandrels 253' and 253'' extend into different holes 204 is that the mandrels can be provided with pointed tips and that the mandrels can extend through more than one-half of leaves or sheets in the respective pads 205. This insures that the mandrels can displace the sheets in the longitudinal direction of or at right angles to the perforated marginal portions of the sheets even though the tips of the mandrels move slightly outwardly during pivoting from the positions shown in FIG. 20*b* to the positions shown in FIG. 21*b*. Therefore, it is not necessary to control the axial positions of the mandrels with a high degree of accuracy while the mandrels pivot with respect to each other.

The operation of the aligning unit 208 is as follows:

FIG. 18 shows the parts of the aligning unit 208 in their starting positions. The carriers 215*a* and 215*b* are remote from the turret 202 each holder 203 of which includes two jaws or gripping means 206 coupled to each other by a linkage 207 and serving to engage the outer leaves of a row of note books or pads 205. One of a full row of straight holes in the pads 205 which are clamped by the jaws 206 is shown at 204. The carriers 215*a*, 215*b* are held in their outer end positions by the crank drive 219. The carriers 216*a*, 216*b* are also held in their outer end positions because they are respectively coupled to the carriers 215*a*, 215*b* by motion converting means 234*a'*, 234*b'*. This allows for indexing of the turret 202 in order to move a fresh row of piles or pads 205 into register with the aligning unit 208.

Figure 19A:
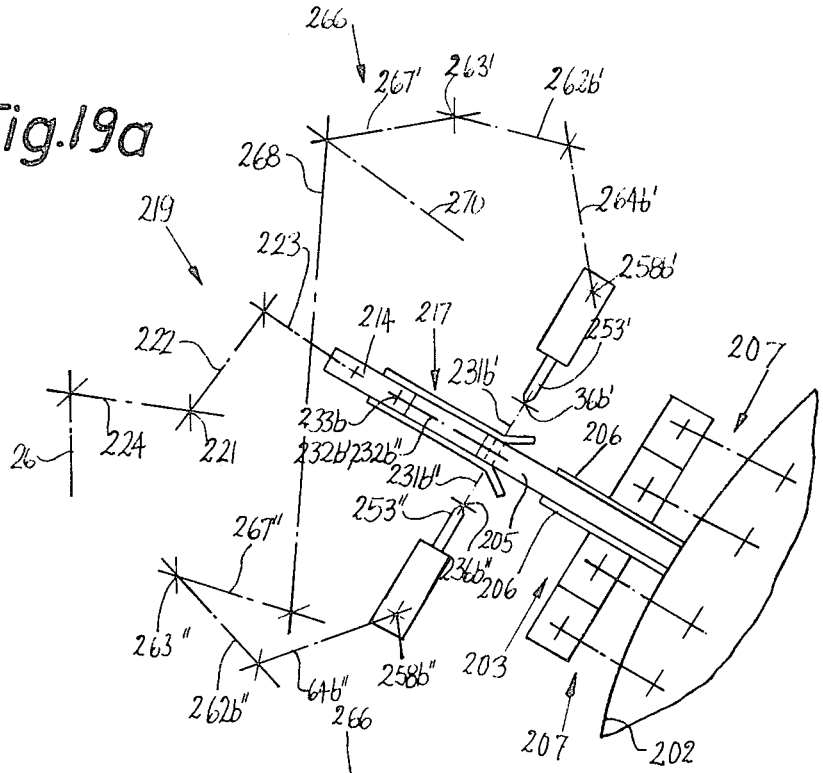
FIG. 19*a* illustrates the structure of FIG. 18 with the parts in positions they assume prior to first converting step.
Figure 19B:
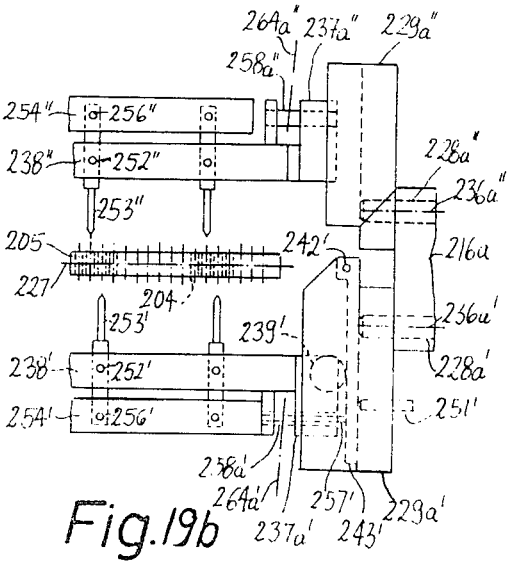
FIG. 19*b* is a fragmentary schematic plan view of the structure of FIg. 19*a;*

The rod 226 thereupon receives motion from its cam to actuate the crank drive 219 which moves the carriers 215*a*, 215*b* and 216*a*, 216*b* toward the turret 202. This moves the bifurcated portions 217 of the jacket 214 toward the pads 205 and such bifurcated portions straddle the outermost (perforated) portions of the piles or pads in the region of the straight holes 204. The corresponding position of the jacket 214 and of its bifurcated portions 217 is shown in FIGS. 19*a* and 19*b*. A comparison of FIG. 18 with FIGS. 19*a* and 19*b* shows that the mandrels 253', 253" (which have been moved by the guides 229*a'*, 229*b'* and 229*a"*, 229*b"*, respectively have moved slightly away from each other because the driving assembly 266 (and more particularly the motion transmitting rod 270) remained idle, i.e., in the position shown in FIG. 18. In FIGS. 19*a* and 19*b*, the mandrels 253' and 253" are in register with the adjacent straight holes 204 of the pads 205. It is not necessary to provide a discrete pair of mandrels 253', 253" for each and every hole 204 of the entire group of pads 205 (see FIG. 16 which shows that the bifurcated portions 217 of the jacket 214 overlie several holes 204). The carriers 216*a*, 216*b* have assumed their inner end positions and respectively abut against the brackets or stops 211*a*, 211*b*.

Figure 20A:
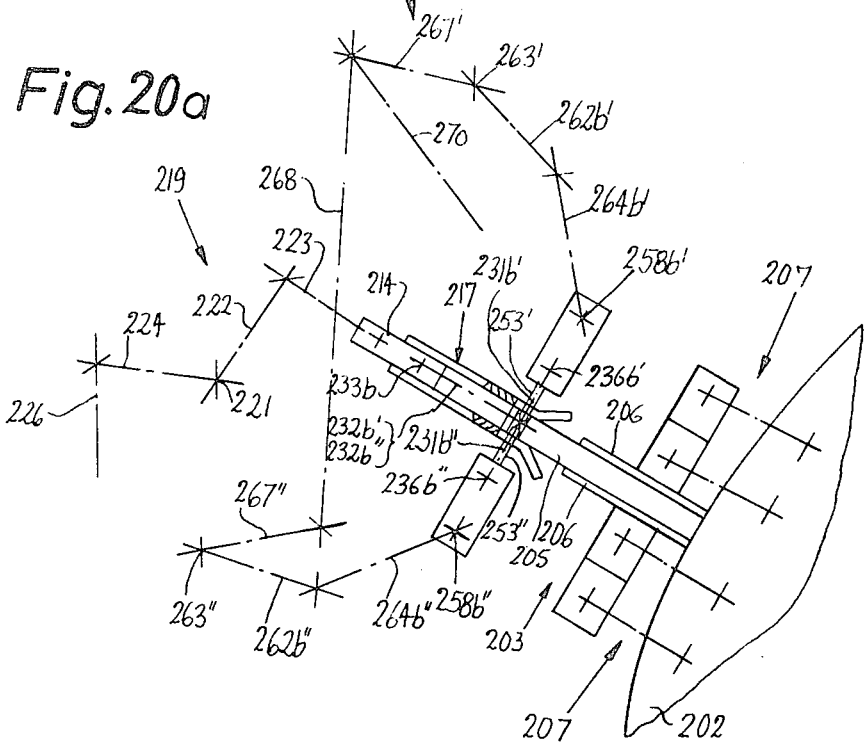
FIG. 20*a* illustrates the structure of FIG. 18 with the parts in positions they assume upon completion of the first converting step.
Figure 20B:
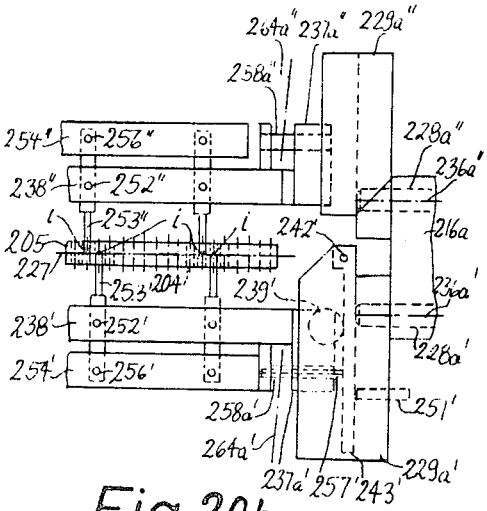
FIG. 20*b* is a fragmentary schematic plan view of the structure shown in FIG. 20*a;*

During the next phase, the crank drive 219 remains idle (i.e., the motion transmitting rod 226 tracks a cylindrical portion of the respective cam) while the motion transmitting rod 270 actuates the driving assembly 266 so that the shafts 263', 263" turn about their respective axes to move the mandrels 253', 253" toward each other whereby the tips of the mandrels 253', 253" penetrate into the adjacent straight holes 204. The final portion of this phase is shown in FIGS. 20*a* and 20*b*.

The cam which was mentioned in connection with the holders 38 of the turret 32 and an equivalent of which is also associated with the turret 202 thereupon moves the jaws 206 of the holder 203 at the aligning station away from each other so that the jaws release the outermost leaves of the pads 205 whose radially outermost portions extend into the compartment between the prongs of bifurcated portions 217 of the jacket 214. The linkage 207 insures that the jaws 206 move through identical distances (it will be understood, however, that it suffices to move only one of the jaws 206 toward or away from the other jaw in order to respectively clamp or release a row of pads 205 in the respective holder 203).

When the pads 205 are released, the motion transmitting rod 226 again actuates the crank drive 219 while the driving assembly 266 remains idle. Consequently, the carriers 215*a* and 215*b* advance toward the turret 202 and move the jacket 214 in the same direction. The carriers 216*a*, 216*b* abut against the respective brackets or stops 211*a*, 211*b*, i.e., the carriers 215*a*, 215*b* move relative to the carriers 216*a*, 216*b*. This causes the motion converting means 234*a'*, 234*a"*, 234*b'*, 234*b"* to move the guides 229*a'*, 229*a"*, 229*b'*, 229*b"* (and hence the mandrels 253', 253") about the respective axes 236*a'*, 236*b'*, 236*a"*, 236*b"* of the corresponding shafts 228*a'*-228*b"*. At the same time, the rollers 239' and 239" pivot the levers 246', 246" and thereby cause the pins 251', 251" to respectively pivot the cams 243', 243" about the axes of the corresponding shafts 242', 242". Such pivoting of the cams 243', 243" respectively causes the supports or rods 238', 254' and 238", 254" to pivot the mandrels 253' and 253" about imaginary axes i which are aligned with the axes of the members 242', 242". Pivoting of the mandrels 253', 253" (under the action of the crank drive 219) entails a relatively small shifting of mandrels with respect to the guides 229*a'*-229*b"* under the action of the cam 269 on the shaft 221, roller 271, lever 272, shaft 263', lever 267', rod 268, lever 267" and shaft 263". This compensates for unavoidable (though minor) retraction of mandrels 253', 253" from the respective holes 204. As mentioned above, the mandrels can extend through more than one-half of sheets in the respective pads to compensate for such retraction.

Figure 21B:
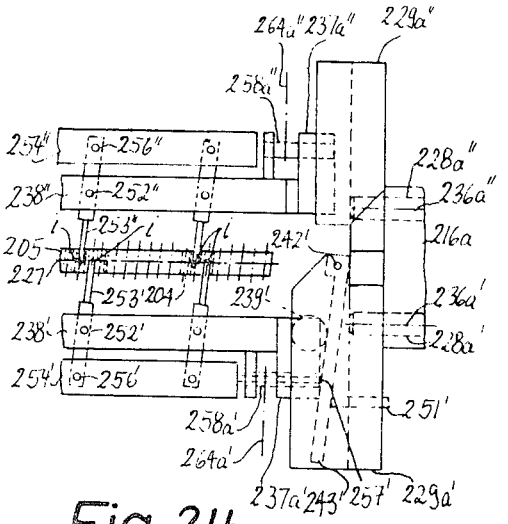
FIG. 21*b* is a fragmentary schematic plan view of the structure shown in FIG. 21*a;*
Figure 21A:
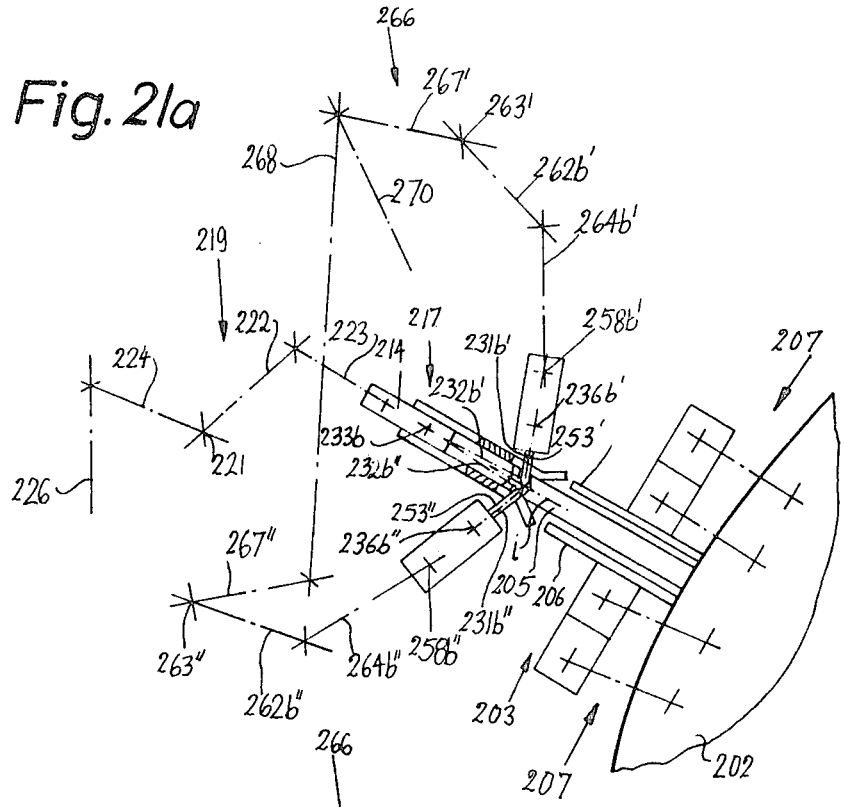
FIG. 21*a* illustrates the structure of FIG. 18 with the parts in positions they assume upon completion of the second converting step.

The just described positions of the mandrels 253', 253", in which the mandrels convert each straight hole 204 into a V-shaped passage or hole and at the same time move such passage out of a plane which is normal to the axis of the turret 202, are shown in FIGS. 21*a* and 21*b*. The inclination or distortion of each V-shaped hole or passage corresponds to or resembles the helix angle of the spiral which is to be introduced into the holes. The V-shape of each passage or hole resembles the curvature of the projection of a convolution of the spiral into a plane which is normal to the axis of the spiral, and the inclination of each V-shaped passage or hole resembles the helix angle of the spiral.

Figure 22B:
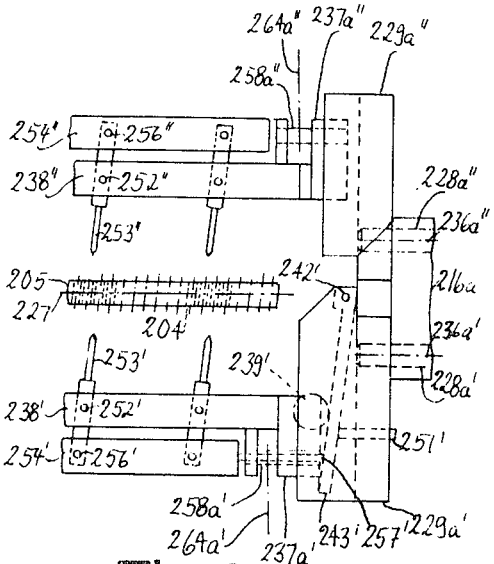
* and FIG. 22*b* is a fragmentary plan view of the structure shown in FIG. 22*a*.
Figure 22A:
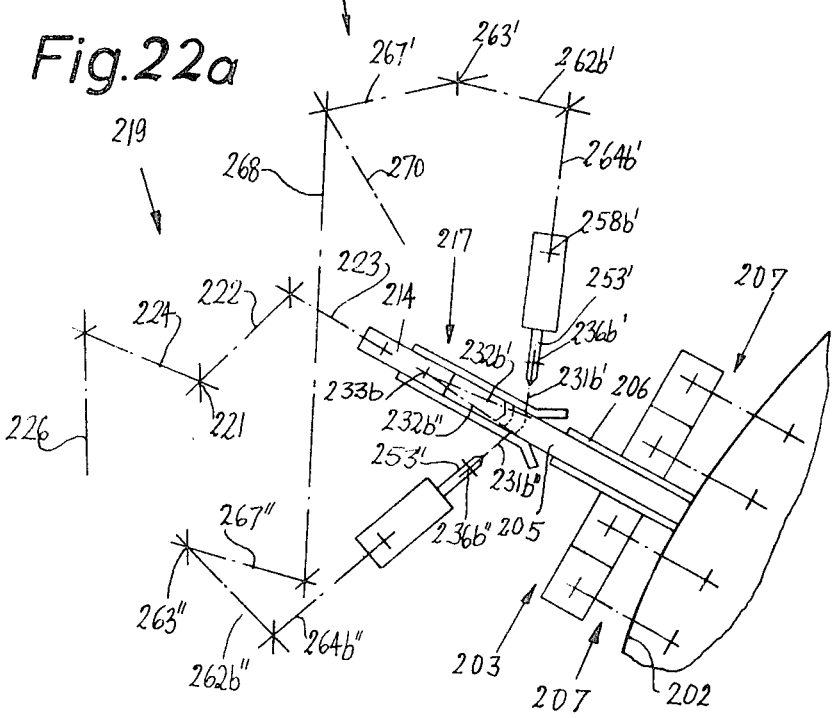
FIG. 22*a* illustrates the structure of FIG. 18 with the parts in positions between those shown in FIGS. 18 and 21*a*–21*b.

The linkage 207 thereupon returns the jaws 206 of the holder 203 into engagement with the outermost leaves of the piles or pads 205 so that the configuration of the V-shaped passages or holes remains unchanged. In the next step, the motion transmitting rod 270 causes the driving assembly 266 to withdraw the mandrels 253', 253" from the respective V-shaped passages or holes. The final part of such phase is shown in FIGS. 22*a* and 22*b*. The motion transmitting rod 226 thereupon actuates the cam drive 219 to move the carriers 215*a*, 215*b* away from the turret 202. During the initial stage of such movement of the carriers 215*a*, 215*b*, the carriers 216*a*, 216*b* continue to abut against the respective brackets or stops 211*a*, 211*b*, i.e., the motion converting means 234*a'*-234*b"* reassume their starting positions of FIG. 18, the same as the adjusting means 244', 244" which return the mandrels 253', 253" to the positions shown in FIG. 19*a*. The stops 235' and 235" and the motion converting means 234*a'*, 234*b'* thereupon return the carriers 216*a*, 216*b* to the starting positions whereby the mandrels 253', 253" return to the positions of FIG. 18. The aligning unit 208 is then ready to manipulate the next set of piles or pads 205 which move into register with the jacket 214 in response to renewed indexing of the turret 202. The pads 205 whose perforations form inclined or distorted V-shaped passages or holes move into register with the spiral introducing unit.

The aligning unit 208 of FIGS. 16 to 22*b* exhibits a number of important advantages. Thus, the unit can operate properly by resorting to only two drives one of which moves the mandrels 253', 253" toward or away from each other and the other of which pivots the inserted mandrels about an axis which is parallel to the perforated marginal portions of the sheets and about the aforementioned axes i. The jacket 214 insures that the perforated portions of sheets are properly confined while the jaws 206 are disengaged from the outermost sheets of the pad or pads 205 in the holder 203. The tie rods 212*a*, 212*b* guide the jacket 214 as well as the carriers 216*a*, 216*b* for the mandrels. The aforementioned coupling or motion converting means 234*a'*-234*b"* allow for relative movement of the jacket 214 and carriers 216*a*, 216*b*. The inserted mandrels 253', 253" perform movements in several planes (i.e., their movements are not planar movements but rather three-dimensional movements). This contributes to rapid completion of the conversion of straight holes 204 into passages which can receive successive convolutions of the spiral.

It will be readily appreciated that the turret 32 or 202 constitutes but one form of conveyor means which can be utilized to transport pads to and beyond the aligning units 33, 34 of FIGS. 1–15 or to and beyond the aligning unit 208 of FIGS. 16–22*b*.

FIG. 18 shows that the arrangement of FIGS. 16 and 17 is located at the ten o'clock position with respect to the turret 202. This means that, if desired or necessary, the apparatus of FIGS. 1–15 can be equipped with the arrangement including the aligning units 33, 34 of FIG. 1*b* as well as with the arrangement including the aligning unit 208 of FIGS. 16–17, or that the units 33, 34 can be removed when the unit 208 of FIGS. 16–17 is installed at the ten o'clock position of the turret. The controls of the apparatus are then adjusted to insure that the jaws of successive holders temporarily release the sheets of the piles or pads in synchronism with operation of the aligning unit 208 of FIGS. 16–17.

An advantage of the aligning unit 208 of FIGS. 16 and 17 is that coarse as well as final conversion of straight holes into holes or passages of appropriate shape take place at one and the same aligning station. On the other hand, the aligning units 33, 34 exhibit the advantage that each thereof is relatively simple and that the unit 34 can convert V-shaped holes or passages into arcuate holes or passages whose radii and helix angles match the corresponding parameters of the spiral. The inserted mandrels 53′ and 53″ merely pivot about axes which are parallel to the axis of the spiral (i.e., to the straight row of perforations in a sheet). On the other hand, the inserted mandrels 253′, 253″ pivot first about axes which are parallel to a row of perforations and simultaneously or thereupon pivot about axes which are normal to the plane of an adjacent sheet. Therefore, the arrangement of FIGS. 16 and 17 can dispense with the comb 71. If desired, pivoting of mandrels 253′, 253″ about the axes i can precede the pivoting of such mandrels about an axis which is parallel to the perforated marginal portions of the sheets. This merely involves minor modifications of means for pivoting the mandrels.

Presently known apparatus for introducing spirals into pads or the like are invariably designed in such a way that the radius of curvature and helix angle of each passage match the corresponding parameters of the spiral. Reference may be had, for example, to German Pat. No. 1,817,815 to Bielomatik. This also applies for the apparatus of FIGS. 1–15; however, the first stage of conversion of straight holes into passages whose radii and helix angles match the radius and helix angle of a convolution of a spiral is radically different from first stages of conversion in heretofore known apparatus. The arrangement of FIGS. 16 and 17 has been designed upon recognition that a spiral can be readily introduced into a pile or pad even if the passages of the pad merely resemble but are not exactly complementary to the convolutions of the spiral. Thus, instead of imparting to each passage a curvature which matches the curvature of the convolutions of the spiral, the arrangement of FIGS. 16 and 17 (a) converts each straight hole into a V-shaped hole or passage, and (b) converts each V-shaped passage or each straight hole into a distorted or modified hole or passage which still resembles a "V" but whose inclination with respect to the plane of a sheet in the corresponding pile or pad approximates the helix angle of the spiral. In other words, the second converting step can be compared with a step of distorting or deforming an originally flat "V" in the following way: One leg of the "V" is moved to one side and the other leg of the "V" is moved to the other side of the plane of the originally flat "V".

Experiments with heretofore known apparatus and with the apparatus of the present invention prove that exact conformance of curvature of passages to the curvature of convolutions of the spiral is not critical and that exact conformance of the helix angle is also not critical. Thus, substantially V-shaped passages will not interfere with the threading of a spiral into a pad as long as the V-shaped passages are distorted in the aforedescribed manner so that their helix angles (i.e., their inclination with respect to the planes of the sheets) approximate the helix angles of the convolutions. Such distorted V-shaped passages allow for automatic threading of short, medium long or very long spirals. In other words, a long spiral can be introduced into the passages of a row of two or more aligned pads. It will be readily appreciated that the conversion of straight holes into passages or holes whose curvature and inclination merely approximate but do not match the corresponding parameters of a spiral can be carried out in a relatively simple, compact and inexpensive apparatus. Moreover, the conversion takes up less time so that the improved apparatus can turn out large numbers of finished pads per unit of time. Still further, and as explained in connection with FIGS. 16 to 22*b*, the conversion of straight holes into passages of appropriate configuration can be completed at a single station. This holds true regardless of whether the apparatus of FIGS. 16–22*b* treats one (small, medium-sized or large) pad at a time, or simultaneously treats a full row of several pads. The conversion of straight holes into V-shaped passages is or can be immediately preceded or followed by, or can take place simultaneously with, conversion into distorted V-shaped passages because both conversions are carried out by resorting to one and the same set of instrumentalities which need not be detached from the pad or pads upon completion of the first converting step.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of changing the shape of straight holes consisting of registering perforations provided in an elongated marginal portion of each sheet of a pile of sheets which are about to receive a spiral having a predetermined radius and a predetermined helix angle and serving to hold the sheets of the pile together, comprising the steps of moving at least some sheets of said pile in a first direction substantially at right angles to the respective elongated marginal portions and moving at least some sheets of said pile in a second direction which is substantially parallel to the respective elongated marginal portions whereby the movements of sheets in said first direction result in conversion of said straight holes into substantially V-shaped holes whose configuration resembles the projection of a convolution of said spiral into a plane which is normal to the axis of said spiral, and the movements of sheets in said second direction result in inclination of said holes with respect to the planes of said sheets at an angle which at least approximates said helix angle.

2. A method as defined in claim 1, wherein one of said steps precedes the other of said steps.

3. A method as defined in claim 1, wherein said step of moving the sheets in said first direction comprises introducing a first mandrel into a hole from one side of said pile, introducing a second mandrel into a hole from the other side of said pile, and pivoting at least one of said mandrels with respect to the other of said mandrels.

4. A method as defined in claim 1, wherein said step of moving the sheets in said second direction comprises inserting into at least one of said V-shaped holes an arcuate prong whose radius and helix angle at least approximate said predetermined radius and said predetermined helix angle.

5. A method as defined in claim 1, wherein said step of moving the sheets in said first direction includes introducing a first mandrel into a hole from one side of said pile, introducing a second mandrel into a hole from the other side of said pile and pivoting at least one of said mandrels about a first axis which is substantially parallel to said elongated marginal portions, the other of said steps including pivoting at least one of said mandrels about a second axis which is substantially normal to said first axis.

6. A method as defined in claim 5, wherein said first mentioned pivoting step is carried out substantially simultaneously with said last mentioned pivoting step.

7. A method as defined in claim 1, wherein at least one of said steps includes inserting a first set of mandrels into different holes from one side of said pile, inserting a second set of mandrels into different holes from the other side of said pile, and simultaneously pivoting the mandrels of at least one of said sets about an axis which is substantially parallel to said elongated marginal portions or about axes which are substantially normal to said elongated marginal portions.

8. A method as defined in claim 7, wherein each of said inserting steps includes inserting the mandrels through the corresponding perforations of at least one-half of the total number of sheets in said pile.

9. An arrangement for changing the shape of straight holes consisting of registering perforations provided in an elongated marginal portion of each sheet of a pile of sheets which are about to receive a spiral having a predetermined radius and a predetermined helix angle and serving to hold the pile together, comprising a holder having means for gripping the outermost sheets of the pile while leaving at least some of the holes exposed; and aligning means including means for moving at least some sheets of the pile in said holder in a first direction substantially at right angles to the respective elongated marginal portions and for moving at least some sheets of the pile in said holder in a second direction which is substantially parallel to the marginal portions of the sheets whereby the movements of sheets in said first direction result in conversion of said straight holes into substantially V-shaped holes whose configuration resembles the projection of a convolution of said spiral into a plane which is normal to the axis of the spiral, and the movements of sheets in said second direction result in inclination of said holes with respect to the planes of said sheets at an angle which at least approximates said helix angle, said moving means comprising at least two mandrels disposed at the opposite sides of the pile in said holder means for imparting to said mandrels a composite movement including introducing each mandrel into a hole from the respective side of the pile in said holder and pivoting at least one mandrel with respect to the other mandrel.

10. An arrangement as defined in claim 9, further comprising means for moving said holder from a first to a second station, said aligning means including a first unit disposed at said first station and a second unit disposed at said second station, said mandrels and said movement imparting means forming part of one of said units.

11. An arrangement as defined in claim 10, wherein said one unit is said first unit and said pivoting of said one mandrel results in conversion of said straight holes into said V-shaped holes, said second unit comprising at least one arcuate prong having a radius and a helix angle at least approximating the radius and helix angle of said spiral, and means for inserting said prong into a V-shaped hole at said second station whereby said V-shaped holes are converted into arcuate holes having radii at least approximating said predetermined radius and helix angles at least approximating said predetermined helix angle.

12. An arrangement as defined in claim 10, wherein said means for moving said holder comprises a conveyor which is movable stepwise to transport said holder from said first to said second station.

13. An arrangement as defined in claim 9, wherein said means for imparting to said mandrels said composite movement comprises a jacket defining a compartment for reception of the perforated portion of the pile in said holder and means for moving said jacket relative to the holder between at least one extended position in which the perforated portion of the pile in said holder extends into said compartment and a retracted position, said jacket having apertures through which said mandrels pass while extending into the respective holes of the pile in said holder and said one mandrel being pivoted by said jacket while the latter moves relative to said holder.

14. An arrangement as defined in claim 13, wherein said means for moving said jacket includes means for shifting said jacket between three positions including said retracted position, said one extended position and a second extended position whereby said jacket pivots said one mandrel during shifting from said one to said second extended position.

15. An arrangement as defined in claim 13, further comprising means for disengaging said gripping means from the outermost sheets of the pile in said holder on movement of said jacket to said one extended position.

16. An arrangement as defined in claim 9, wherein said movement imparting means comprises means for pivoting said one mandrel about a first axis which is substantially parallel to said elongated marginal portions to thereby move at least some sheets in said first direction and for pivoting said mandrels about second axes which are normal to said first axis to thereby move at least some sheets in said second direction.

17. An arrangement as defined in claim 16, wherein said movement imparting means further comprises first drive means for effecting the insertion of mandrels into the respective holes of a pile in said holder and second drive means for said pivoting means.

18. An arrangement as defined in claim 16, further comprising a jacket defining a compartment for the perforated portion of a pile in said holder and means for moving said jacket between an extended position in which the perforated portion of the pile in said holder extends into said compartment and a retracted position.

19. An arrangement as defined in claim 18, wherein said jacket comprises a bifurcated portion having prongs flanking said compartment and said mandrels are disposed between the neighboring prongs while such mandrels extend into the respective holes of the pile in said holder.

20. An arrangement as defined in claim 16, further comprising mobile carrier means for said mandrels, guide means defining for said carrier means a path for movement toward and away from said holder, and means for moving said carrier means along said guide means.

21. An arrangement as defined in claim 20, further comprising a jacket defining a compartment for the perforated portion of the pile in said holder, said means for moving said carrier means including means for moving said jacket along said guide means between at least one extended position in which the perforated portion of the pile in said holder extends into said compartment and a retracted position.

22. An arrangement as defined in claim 21, wherein said means for moving said jacket includes means for coupling said jacket to said carrier means with limited freedom of movement of said carrier means and said jacket relative to each other.

23. An arrangement as defined in claim 22, wherein said means for moving said carrier means further comprises drive means connected with said jacket and further comprising stop means for arresting said carrier means on completion of movement of said carrier means toward said holder, said drive means constituting said means for pivoting said mandrels by way of said coupling means.

24. An arrangement as defined in claim 16, wherein said pivoting means comprises a pair of elongated supports for each of said mandrels, said supports being parallel to the elongated marginal portions of sheets of the pile in said holder and said mandrels being pivotable with respect to the corresponding supports, guide means defining paths for movement of said supports toward and away from the holes of the pile in said holder, and means for moving said supports along said guide means.

25. An arrangement as defined in claim 24, wherein said pivoting means further comprises adjusting means for moving a portion of said guide means to thereby pivot said mandrels via said supports while the mandrels extend into the respective holes of the pile in said holder.

26. An arrangement as defined in claim 25, wherein said adjusting means includes means for pivoting said portion of said guide means about an axis which is normal to the elongated perforated marginal portions of sheets of the pile in said holder, and further comprising mobile carrier means for said mandrels, second guide means defining for said carrier means a path along which said mandrels can move toward and away from said holder, means for pivotally connecting said first mentioned guide means to said carrier means for movement about axes which are parallel to the elongated perforated marginal portions of sheets of the pile in said holder, and coupling means connecting said carrier means to said first mentioned guide means so that the latter pivots in response to movement of said carrier means along said second guide means.

27. An arrangement as defined in claim 26, further comprising a jacket having a compartment and being movable between at least one extended position in which the elongated perforated marginal portion of a pile in said holder extends into said compartment and a retracted position, said coupling means comprising crank means connected to said first mentioned guide means and lever means connecting said crank means with said jacket.

28. An arrangement as defined in claim 26, further comprising a jacket having a compartment and being movable between at least one extended position in which the elongated perforated marginal portion of a pile in said holder extends into said compartment and a retracted position, said coupling means including means for moving said carrier means in response to movement of said jacket.

29. An arrangement as defined in claim 24, wherein said supports include rods having end portions and said guide means comprises discrete guides for the end portions of said rods and a pair of cams each pivoted to a different one of said discrete guides, said cams being disposed at the opposite ends of said rods and said pivoting means further comprising means for pivoting said cams to thereby move selected rods in parallelism with the elongated marginal portions of sheets of the pile in said holder and further comprising first and second mobile carriers each supporting two of said discrete guides, one of said carriers being adjacent to one of said cams and the other of said carriers being adjacent to the other of said cams.

30. An arrangement as defined in claim 29, further comprising motion converting means arranged to pivot selected rods about the axes of such rods by way of the corresponding discrete guides.

31. An arrangement as defined in claim 24, further comprising carrier means for said guide means, second guide means defining for said carrier means a path for movement toward and away from the elongated perforated marginal portions of sheets of the pile in said holder, said second guide means comprising elongated tie rods and further comprising bearings interposed between said tie rods and said carrier means.

32. An arrangement as defined in claim 16, further comprising carrier means for said mandrels, guide means defining for said carrier means a path along which said carrier means is movable toward and away from the elongated perforated marginal portions of sheets of the pile in said holder, a jacket having a compartment and being movable along a second path between at least one extended position in which the elongated perforated marginal portions of sheets of the pile in said holder extend into said compartment and a retracted position, and a crank drive for reciprocating said carrier means and said jacket along the respective paths.

33. An arrangement as defined in claim 16, wherein said movement imparting means further comprises means for moving said mandrels axially between first positions remote from the respective outermost sheets of the pile in said holder and second positions in which said mandrels extend into the respective holes, said means for moving said mandrels axially comprising discrete crank drives for the mandrels at the opposite sides of the pile in said holder and means for synchronizing the movements of said crank drives.

34. An arrangement as defined in claim 33, wherein each of said crank drives comprises a universal joint.

35. An arrangement as defined in claim 16, wherein said movement imparting means comprises a jacket having a compartment and means for moving said jacket between a plurality of positions including a retracted position in which said compartment is remote from the elongated perforated marginal portions of sheets of the pile in said holder, a first extended position in which said perforated marginal portions extend into said compartment, and a second extended position in which said perforated marginal portions continue to extend into said compartment, said movement imparting means further comprising means for pivoting said mandrels in response to movement of said jacket between said extended positions.

36. An arrangement as defined in claim 16, further comprising an indexible turret for said holder and means for disengaging said gripping means from the pile in said holder while said motion imparting means pivots said mandrels.

* * * * *